US007126051B2

(12) United States Patent
Fay et al.

(10) Patent No.: US 7,126,051 B2
(45) Date of Patent: Oct. 24, 2006

(54) AUDIO WAVE DATA PLAYBACK IN AN AUDIO GENERATION SYSTEM

(75) Inventors: Todor J. Fay, Bellevue, WA (US); Robert S. Williams, Seattle, WA (US); Francisco J. Wong, Bellevue, WA (US)

(73) Assignee: Microsoft Corporation, Redmond, WA (US)

( * ) Notice: Subject to any disclaimer, the term of this patent is extended or adjusted under 35 U.S.C. 154(b) by 512 days.

(21) Appl. No.: 10/092,944

(22) Filed: Mar. 5, 2002

(65) Prior Publication Data

US 2002/0121181 A1 Sep. 5, 2002

Related U.S. Application Data

(60) Provisional application No. 60/273,593, filed on Mar. 5, 2001.

(51) Int. Cl.
*G10H 7/00* (2006.01)

(52) U.S. Cl. ..... 84/609; 84/610; 84/622; 84/625; 84/634

(58) Field of Classification Search ..... 84/600–606, 84/609–610, 622–627, 633–634, 649–650, 84/659–663, 665–666
See application file for complete search history.

(56) References Cited

U.S. PATENT DOCUMENTS 5,142,961 A * 9/1992 Paroutaud ..... 84/726
5,303,218 A 4/1994 Miyake
5,315,057 A * 5/1994 Land et al. ..... 84/601
5,331,111 A 7/1994 O'Connell
5,511,002 A 4/1996 Milne et al.
5,548,759 A 8/1996 Lipe
5,717,154 A 2/1998 Gulick
5,734,119 A 3/1998 France et al.
5,761,684 A 6/1998 Gibson
5,768,545 A 6/1998 Solomon et al.
5,778,187 A 7/1998 Monteiro et al.
5,792,971 A * 8/1998 Timis et al. ..... 84/609
5,842,014 A 11/1998 Brooks et al.
5,852,251 A 12/1998 Su et al.
5,890,017 A 3/1999 Tulkoff et al.
5,902,947 A 5/1999 Burton et al.
5,942,707 A 8/1999 Tamura
5,977,471 A 11/1999 Rosenzweig
5,990,879 A 11/1999 Mince (Continued)

OTHER PUBLICATIONS

Waid, Fred; "APL and the Media"; Proceedings of the Tenth APL as a Tool of Thought Conference; held at Stevens Institute of TEchnology Hoboken, New Jersey, Jan. 31, 1998; pp. 111 through 122.

(Continued)

*Primary Examiner*—Marlon Fletcher
(74) *Attorney, Agent, or Firm*—Lee & Hayes, PLLC

(57) ABSTRACT

An audio generation system includes MIDI track components that generate event instructions for MIDI audio data received from a MIDI audio data source, and includes audio wave track components that generate playback instructions for audio wave data maintained in an audio wave data source. A segment component plays one or more of the MIDI track components to generate the event instructions, and plays one or more of the audio wave track components to generate the playback instructions. An audio processing component, such as a synthesizer component, receives the event instructions and the playback instructions, and generates an audio rendition corresponding to the MIDI audio data and/or the audio wave data.

57 Claims, 8 Drawing Sheets

U.S. PATENT DOCUMENTS

| | | | | |
|---|---|---|---|---|
| 6,044,408 | A | 3/2000 | Engstrom et al. | |
| 6,100,461 | A | 8/2000 | Hewitt | |
| 6,152,856 | A | 11/2000 | Studor et al. | |
| 6,160,213 | A * | 12/2000 | Arnold et al. | 84/615 |
| 6,169,242 | B1 | 1/2001 | Fay et al. | |
| 6,173,317 | B1 | 1/2001 | Chaddha et al. | |
| 6,175,070 | B1 | 1/2001 | Naples et al. | |
| 6,180,863 | B1 | 1/2001 | Tamura | |
| 6,216,149 | B1 | 4/2001 | Conner et al. | |
| 6,225,546 | B1 * | 5/2001 | Kraft et al. | 84/609 |
| 6,233,389 | B1 | 5/2001 | Barton et al. | |
| 6,301,603 | B1 | 10/2001 | Maher et al. | |
| 6,357,039 | B1 | 3/2002 | Kuper | |
| 6,433,266 | B1 * | 8/2002 | Fay et al. | 84/609 |
| 6,541,689 | B1 * | 4/2003 | Fay et al. | 84/601 |
| 6,628,928 | B1 | 9/2003 | Crosby et al. | |
| 6,640,257 | B1 * | 10/2003 | MacFarlane | 710/1 |
| 6,658,309 | B1 | 12/2003 | Abrams et al. | |
| 2001/0053944 | A1 | 12/2001 | Marks et al. | |
| 2002/0108484 | A1 * | 8/2002 | Arnold et al. | 84/615 |
| 2002/0144587 | A1 * | 10/2002 | Naples et al. | 84/609 |
| 2002/0144588 | A1 * | 10/2002 | Naples et al. | 84/609 |

OTHER PUBLICATIONS

A. Camurri et al., "A Software Architecture for Sound and Music Processing", Microprocessing and Microprogramming vol. 35 pp. 625-632 (Sep. 1992).

Berry M., "An Introduction to GrainWave" Computer Music Journal Spring 1999 vol. 23 No. 1 pp. 57-61.

H. Meeks, "Sound Forge Version 4.0b", Social Science Computer Review vol. 16, No. 2, pp. 205-211 (Summer 1998).

Harris et al.; "The Application of Embedded Transputers in a Professional Digital Audio Mixing System"; IEEE Colloquium on "Transputer Applications"; Digest No. 129, 2/ 1-3 (uk Nov. 13, 1989).

J. Piche et al., "Cecilia: A Production Interface to Csound", Computer Music Journal vol. 22, No. 2 pp. 52-55 (Summer 1998).

M. Cohen et al., "Multidimensional Audio Window Management", Int. J. Man-Machine Studies vol. 34, No. 3 pp. 319-336 (1991).

Malham et al., "3-D Sound Spatialization using Ambisonic Techniques" Computer Music Journal Winter 1995 vol. 19 No. 4 pp. 58-70.

Meyer D., "Signal Processing Architecture for Loudspeaker Array Directivity Control" ICASSP Mar. 1985 vol. 2 pp. 16.7.1-16.7.4.

Miller et al., "Audio-Enhanced Computer Assisted Learning and Computer Controlled Audio-Instruction". Computer Education, Pergamon Press Ltd., 1983, vol. 7 pp. 33-54.

Moorer, James; "The Lucasfilm Audio Signal Processor"; Computer Music Journal, vol. 6, No. 3, Fall 1982, 0148-9267/82/030022-11; pp. 22 through 32.

R. Dannenberg et al., "Real-Time Software Synthesis on Superscalar Architectures", Computer Music Journal vol. 21, No. 3 pp. 83-94 (Fall 1997).

R. Nieberle et al., "CAMP: Computer-Aided Music Processing", Computer Music Journal vol. 15, No. 2, pp. 33-40 (Summer 1991).

Reilly et al., "Interactive DSP Debugging in the Multi-Processor Huron Environment" ISSPA Aug. 1996 pp. 270-273.

Stanojevic et al., "The Total Surround Sound (TSS) Processor" SMPTE Journal Nov. 1994 vol. 3 No. 11 pp. 734-740.

V. Ulianich, "Project FORMUS: Sonoric Space-Time and the Artistic Synthesis of Sound", Leonardo vol. 28, No. 1 pp. 63-66 (1995).

Vercoe, Barry; "New Dimensions in Computer Music"; Trends & Perspectives in Signal Processing; Focus, Apr. 1982; pp. 15 through 23.

Vercoe, et al; "Real-Time CSOUND: Software Synthesis with Sensing and Control"; ICMC Glasgow 1990 for the Computer Music Association; pp. 209 through 211.

Wippler, Jean-Claude; "Scripted Documents"; Proceedings of the 7th USENIX Tcl/ TKConference; Austin Texas; Feb. 14-18, 2000; The USENIX Association.

Bargen, et al., "Inside DirectX", Microsoft Press, 1998, pp. 203-226.

* cited by examiner

AUDIO WAVE DATA PLAYBACK IN AN AUDIO GENERATION SYSTEM

RELATED APPLICATION

This application claims the benefit of U.S. Provisional Application No. 60/273,593, filed Mar. 5, 2001, entitled "Wave Playback Track in the DirectMusic Performance Architecture", to Todor Fay et al., which is incorporated by reference herein.

TECHNICAL FIELD

This invention relates to audio processing and, in particular, to audio wave data playback in an audio generation system.

BACKGROUND

Multimedia programs present content to a user through both audio and video events while a user interacts with a program via a keyboard, joystick, or other interactive input device. A user associates elements and occurrences of a video presentation with the associated audio representation. A common implementation is to associate audio with movement of characters or objects in a video game. When a new character or object appears, the audio associated with that entity is incorporated into the overall presentation for a more dynamic representation of the video presentation.

Audio representation is an essential component of electronic and multimedia products such as computer based and stand-alone video games, computer-based slide show presentations, computer animation, and other similar products and applications. As a result, audio generating devices and components are integrated into electronic and multimedia products for composing and providing graphically associated audio representations. These audio representations can be dynamically generated and varied in response to various input parameters, real-time events, and conditions. Thus, a user can experience the sensation of live audio or musical accompaniment with a multimedia experience.

Conventionally, computer audio is produced in one of two fundamentally different ways. One way is to reproduce an audio waveform from a digital sample of an audio source which is typically stored in a wave file (i.e., a .wav file). A digital sample can reproduce any sound, and the output is very similar on all sound cards, or similar computer audio rendering devices. However, a file of digital samples consumes a substantial amount of memory and resources when streaming the audio content. As a result, the variety of audio samples that can be provided using this approach is limited. Another disadvantage of this approach is that the stored digital samples cannot be easily varied.

Another way to produce computer audio is to synthesize musical instrument sounds, typically in response to instructions in a Musical Instrument Digital Interface (MIDI) file, to generate audio sound waves. MIDI is a protocol for recording and playing back music and audio on digital synthesizers incorporated with computer sound cards. Rather than representing musical sound directly, MIDI transmits information and instructions about how music is produced. The MIDI command set includes note-on, note-off, key velocity, pitch bend, and other commands to control a synthesizer.

The audio sound waves produced with a synthesizer are those already stored in a wavetable in the receiving instrument or sound card. A wavetable is a table of stored sound waves that are digitized samples of actual recorded sound. A wavetable can be stored in read-only memory (ROM) on a sound card chip, or provided with software. Prestoring sound waveforms in a lookup table improves rendered audio quality and throughput. An advantage of MIDI files is that they are compact and require few audio streaming resources, but the output is limited to the number of instruments available in the designated General MIDI set and in the synthesizer, and may sound very different on different computer systems.

MIDI instructions sent from one device to another indicate actions to be taken by the controlled device, such as identifying a musical instrument (e.g., piano, flute, drums, etc.) for music generation, turning on a note, and/or altering a parameter in order to generate or control a sound. In this way, MIDI instructions control the generation of sound by remote instruments without the MIDI control instructions themselves carrying sound or digitized information. A MIDI sequencer stores, edits, and coordinates the MIDI information and instructions. A synthesizer connected to a sequencer generates audio based on the MIDI information and instructions received from the sequencer. Many sounds and sound effects are a combination of multiple simple sounds generated in response to the MIDI instructions.

A MIDI system allows audio and music to be represented with only a few digital samples rather than converting an analog signal to many digital samples. The MIDI standard supports different channels that can each simultaneously provide an output of audio sound wave data. There are sixteen defined MIDI channels, meaning that no more than sixteen instruments can be playing at one time. Typically, the command input for each MIDI channel represents the notes corresponding to an instrument. However, MIDI instructions can program a channel to be a particular instrument. Once programmed, the note instructions for a channel will be played or recorded as the instrument for which the channel has been programmed. During a particular piece of music, a channel can be dynamically reprogrammed to be a different instrument.

A Downloadable Sounds (DLS) standard published by the MIDI Manufacturers Association allows wavetable synthesis to be based on digital samples of audio content provided at run-time rather than stored in memory. The data describing an instrument can be downloaded to a synthesizer and then played like any other MIDI instrument. Because DLS data can be distributed as part of an application, developers can be assured that the audio content will be delivered uniformly on all computer systems. Moreover, developers are not limited in their choice of instruments.

A DLS instrument is created from one or more digital samples, typically representing single pitches, which are then modified by a synthesizer to create other pitches. Multiple samples are used to make an instrument sound realistic over a wide range of pitches. DLS instruments respond to MIDI instructions and commands just like other MIDI instruments. However, a DLS instrument does not have to belong to the General MIDI set or represent a musical instrument at all. Any sound, such as a fragment of speech or a fully composed measure of music, can be associated with a DLS instrument.

Conventional Audio and Music System

FIG. 1 illustrates a conventional audio and music generation system 100 that includes a synthesizer 102, a sound effects input source 104, and a buffers component 106. Typically, a synthesizer is implemented in computer software, in hardware as part of a computer's internal sound card, or as an external device such as a MIDI keyboard or module. Synthesizer 102 receives MIDI inputs on sixteen channels 108 that conform to the MIDI standard. Synthesizer 102 includes a mixing component 110 that mixes the audio sound wave data output from synthesizer channels 108. An output 112 of mixing component 110 is input to an audio buffer in the buffers component 106.

MIDI inputs to synthesizer 102 are in the form of individual instructions, each of which designates the MIDI channel to which it applies. Within synthesizer 102, instructions associated with different channels 108 are processed in different ways, depending on the programming for the various channels. A MIDI input is typically a serial data stream that is parsed in synthesizer 102 into MIDI instructions and synthesizer control information. A MIDI command or instruction is represented as a data structure containing information about the sound effect or music piece such as the pitch, relative volume, duration, and the like.

A MIDI instruction, such as a "note-on", directs synthesizer 102 to play a particular note, or notes, on a synthesizer channel 108 having a designated instrument. The General MIDI standard defines standard sounds that can be combined and mapped into the sixteen separate instrument and sound channels. A MIDI event on a synthesizer channel 108 corresponds to a particular sound and can represent a keyboard key stroke, for example. The "note-on" MIDI instruction can be generated with a keyboard when a key is pressed and the "note-on" instruction is sent to synthesizer 102. When the key on the keyboard is released, a corresponding "note-off" instruction is sent to stop the generation of the sound corresponding to the keyboard key.

The audio representation for a video game involving a car, from the perspective of a person in the car, can be presented for an interactive video and audio presentation. The sound effects input source 104 has audio data that represents various sounds that a driver in a car might hear. A MIDI formatted music piece 114 represents the audio of the car's stereo. Input source 104 also has digital audio sample inputs that are sound effects representing the car's horn 116, the car's tires 118, and the car's engine 120.

The MIDI formatted input 114 has sound effect instructions 122(1–3) to generate musical instrument sounds. Instruction 122(1) designates that a guitar sound be generated on MIDI channel one (1) in synthesizer 102, instruction 120(2) designates that a bass sound be generated on MIDI channel two (2), and instruction 120(3) designates that drums be generated on MIDI channel ten (10). The MIDI channel assignments are designated when MIDI input 114 is authored, or created.

A conventional software synthesizer that translates MIDI instructions into audio signals does not support distinctly separate sets of MIDI channels. The number of sounds that can be played simultaneously is limited by the number of channels and resources available in the synthesizer. In the event that there are more MIDI inputs than there are available channels and resources, one or more inputs are suppressed by the synthesizer.

The buffers component 106 of audio system 100 includes multiple buffers 124(1–4). Typically, a buffer is an allocated area of memory that temporarily holds sequential samples of audio sound wave data that will be subsequently communicated to a sound card or similar audio rendering device to produce audible sound. The output 112 of synthesizer mixing component 110 is input to buffer 124(1) in buffers component 106. Similarly, each of the other digital sample sources are input to a buffer 124 in buffers component 106. The car horn sound effect 116 is input to buffer 124(2), the tires sound effect 118 is input to buffer 124(3), and the engine sound effect 120 is input to buffer 124(4).

Another problem with conventional audio generation systems is the extent to which system resources have to be allocated to support an audio representation for a video presentation. In the above example, each buffer 124 requires separate hardware channels, such as in a soundcard, to render the audio sound effects from input source 104. Further, in an audio system that supports both music and sound effects, a single stereo output pair that is input to one buffer is a limitation to creating and enhancing the music and sound effects.

Similarly, other three-dimensional (3-D) audio spatialization effects are difficult to create and require an allocation of system resources that may not be available when processing a video game that requires an extensive audio presentation. For example, to represent more than one car from a perspective of standing near a road in a video game, a pre-authored car engine sound effect 120 has to be stored in memory once for each car that will be represented. Additionally, a separate buffer 124 and separate hardware channels will need to be allocated for each representation of a car. If a computer that is processing the video game does not have the resources available to generate the audio representation that accompanies the video presentation, the quality of the presentation will be deficient.

SUMMARY

An audio generation system includes MIDI track components that generate event instructions for MIDI audio data received from a MIDI audio data source, and includes audio wave track components that generate playback instructions for audio wave data maintained in an audio wave data source. A segment component plays one or more of the MIDI track components to generate the event instructions, and plays one or more of the audio wave track components to generate the playback instructions. An audio processing component, such as a synthesizer component, receives the event instructions and the playback instructions, and generates an audio rendition corresponding to the MIDI audio data and/or the audio wave data.

The audio generation system can also include one or more segment states that include programming references to the MIDI track components and to the audio wave track components. A segment state initiates the segment component to play the MIDI track components and the audio track components to generate the event instructions and the playback instructions. For each of the segment states, the audio processing component generates an audio rendition corresponding to the MIDI audio data and/or to the audio wave data.

In one embodiment, the segment component is implemented as a programming object having an interface that is callable by a performance manager to initiate that the segment component play the MIDI track components and the audio wave track components. Further, the MIDI track components and the audio wave track components are programming objects each having an interface that is callable by the segment component to initiate that the MIDI track components generate the event instructions, and to initiate that the audio wave track components generate the playback instructions.

BRIEF DESCRIPTION OF THE DRAWINGS

The same numbers are used throughout the drawings to reference like features and components.

DETAILED DESCRIPTION

The following describes systems and methods for audio wave data playback in an audio generation system that supports numerous computing systems' audio technologies, including technologies that are designed and implemented after a multimedia application program has been authored. An application program instantiates the components of an audio generation system to produce, or otherwise generate, audio data that can be rendered with an audio rendering device to produce audible sound.

Multiple segment tracks are implemented as needed in an audio generation system to play both audio wave data and MIDI audio data. It is preferable to implement some multimedia applications with streaming audio wave data rather than with a MIDI implementation, such as for human vocals. The dynamic playback capabilities of the audio generation systems described herein support playback integration of MIDI audio data and audio wave data. The audio generation systems utilize streaming audio wave data with MIDI based technologies.

An audio generation system includes an audio rendition manager (also referred to herein as an "AudioPath") that is implemented to provide various audio data processing components that process audio data into audible sound. The audio generation system described herein simplifies the process of creating audio representations for interactive applications such as video games and Web sites. The audio rendition manager manages the audio creation process and integrates both digital audio samples and streaming audio.

Additionally, an audio rendition manager provides real-time, interactive control over the audio data processing for audio representations of video presentations. An audio rendition manager also enables 3-D audio spatialization processing for an individual audio representation of an entity's video presentation. Multiple audio renditions representing multiple video entities can be accomplished with multiple audio rendition managers, each representing a video entity, or audio renditions for multiple entities can be combined in a single audio rendition manager.

Real-time control of audio data processing components in an audio generation system is useful, for example, to control an audio representation of a video game presentation when parameters that are influenced by interactivity with the video game change, such as a video entity's 3-D positioning in response to a change in a video game scene. Other examples include adjusting audio environment reverb in response to a change in a video game scene, or adjusting music transpose in response to a change in the emotional intensity of a video game scene.

Exemplary Audio Generation System

Figure 1:
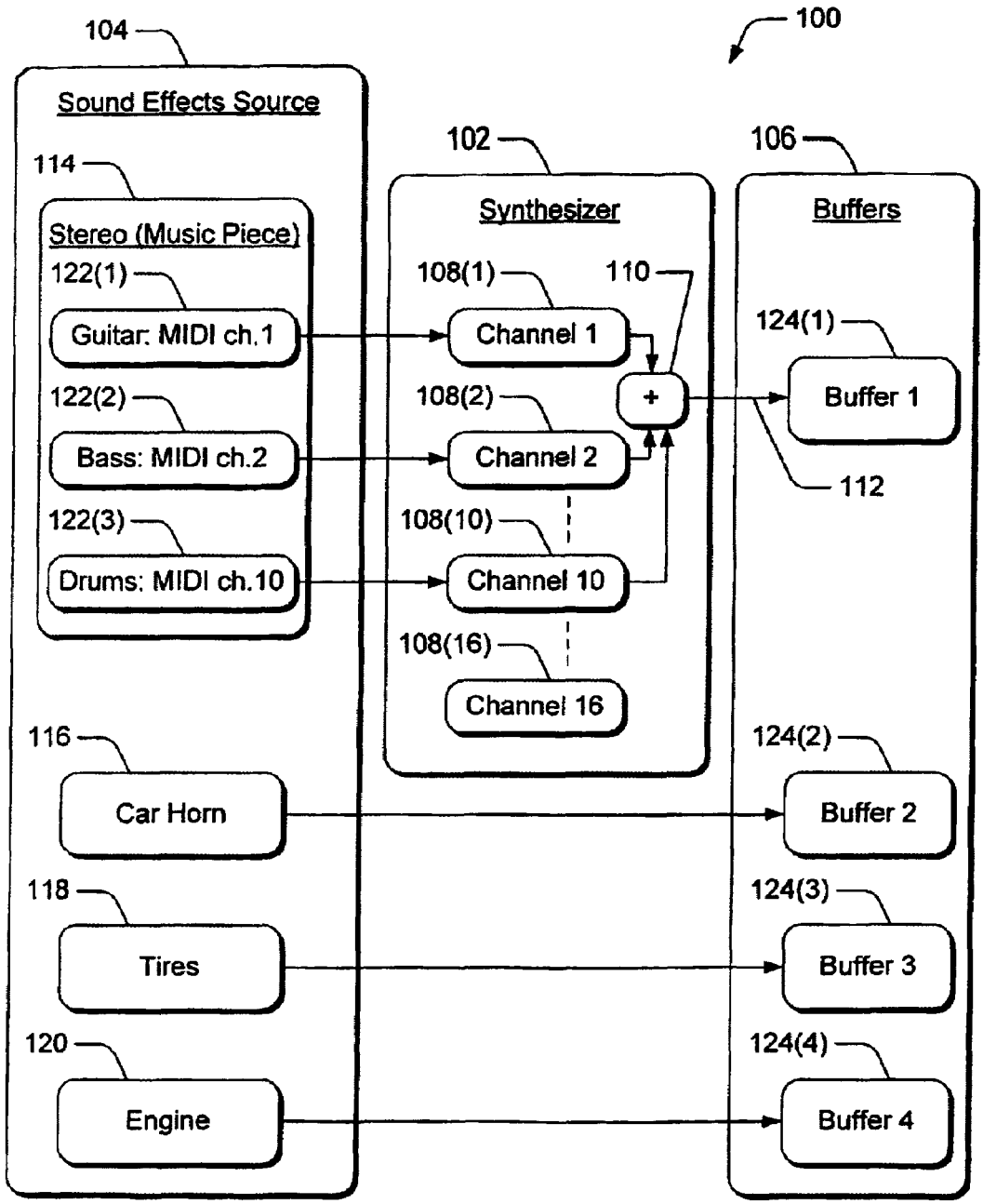
Fig. 1 Prior Art
FIG. 1 illustrates a conventional audio generation system.
Figure 2:
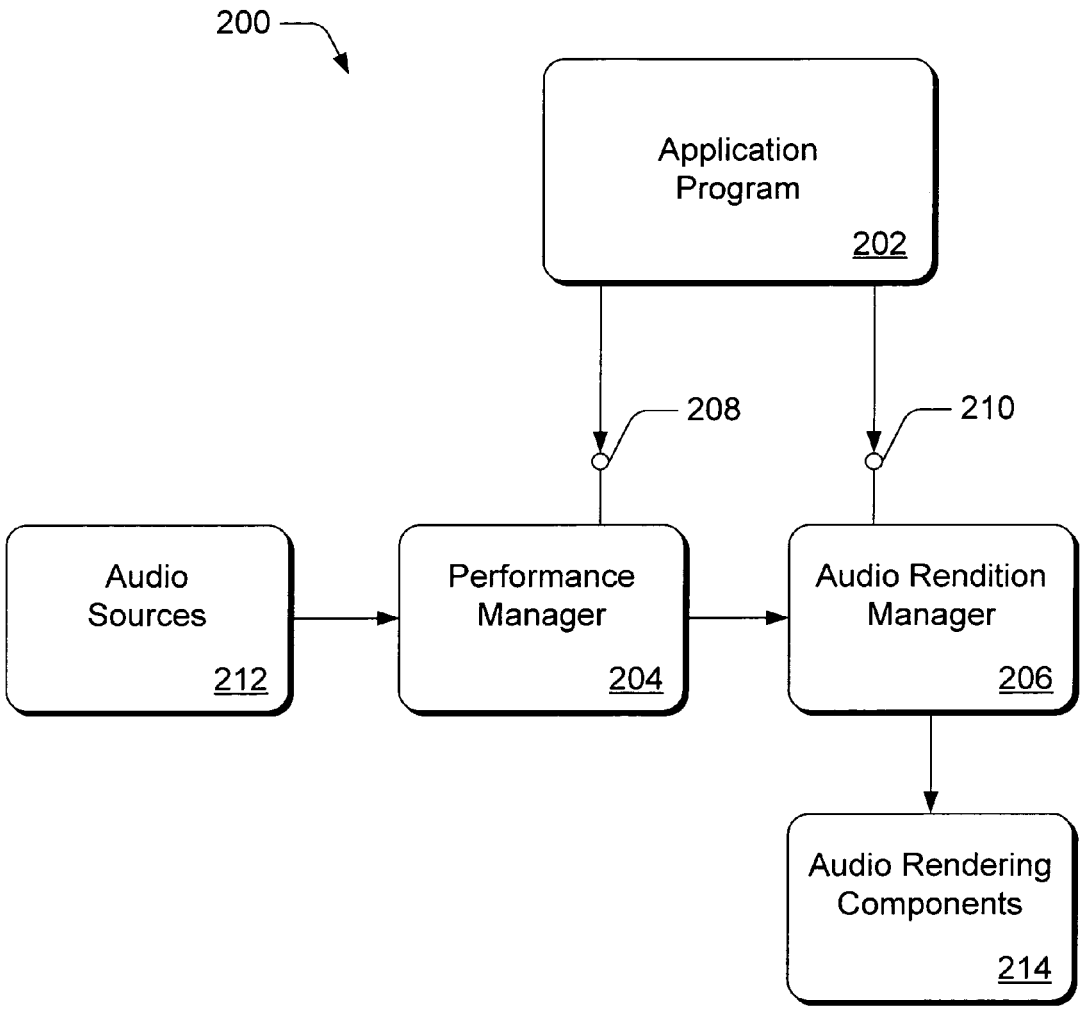
FIG. 2 illustrates various components of an exemplary audio generation system.

FIG. 2 illustrates an audio generation system 200 having components that can be implemented within a computing device, or the components can be distributed within a computing system having more than one computing device. The audio generation system 200 generates audio events that are processed and rendered by separate audio processing components of a computing device or system. See the description of "Exemplary Computing System and Environment" below for specific examples and implementations of network and computing systems, computing devices, and components that can be used to implement the technology described herein.

Audio generation system 200 includes an application program 202, a performance manager component 204, and an audio rendition manager 206. Application program 202 is one of a variety of different types of applications, such as a video game program, some other type of entertainment program, or any other application that incorporates an audio representation with a video presentation.

The performance manager 204 and the audio rendition manager 206 can be instantiated, or provided, as programming objects. The application program 202 interfaces with the performance manager 204, the audio rendition manager 206, and the other components of the audio generation system 200 via application programming interfaces (APIs). For example, application program 202 can interface with the performance manager 204 via API 208 and with the audio rendition manager 206 via API 210.

The various components described herein, such as the performance manager 204 and the audio rendition manager 206, can be implemented using standard programming techniques, including the use of OLE (object linking and embedding) and COM (component object model) interfaces. COM objects are implemented in a system memory of a computing device, each object having one or more interfaces, and each interface having one or more methods. The interfaces and interface methods can be called by application programs and by other objects. The interface methods of the objects are executed by a processing unit of the computing device. Familiarity with object-based programming, and with COM objects in particular, is assumed throughout this disclosure. However, those skilled in the art will recognize that the audio generation systems and the various components described herein are not limited to a COM and/or OLE implementation, or to any other specific programming technique.

The audio generation system 200 includes audio sources 212 that provide digital samples of audio data such as from a wave file (i.e., a .wav file), message-based data such as from a MIDI file or a pre-authored segment file, or an audio sample such as a Downloadable Sound (DLS). Audio sources can be also be stored as a resource component file of an application rather than in a separate file.

Application program 202 can initiate that an audio source 212 provide audio content input to performance manager 204. The performance manager 204 receives the audio content from audio sources 212 and produces audio instructions for input to the audio rendition manager 206. The audio rendition manager 206 receives the audio instructions and generates audio sound wave data. The audio generation system 200 includes audio rendering components 214 which are hardware and/or software components, such as a speaker or soundcard, that renders audio from the audio sound wave data received from the audio rendition manager 206.

Figure 3:
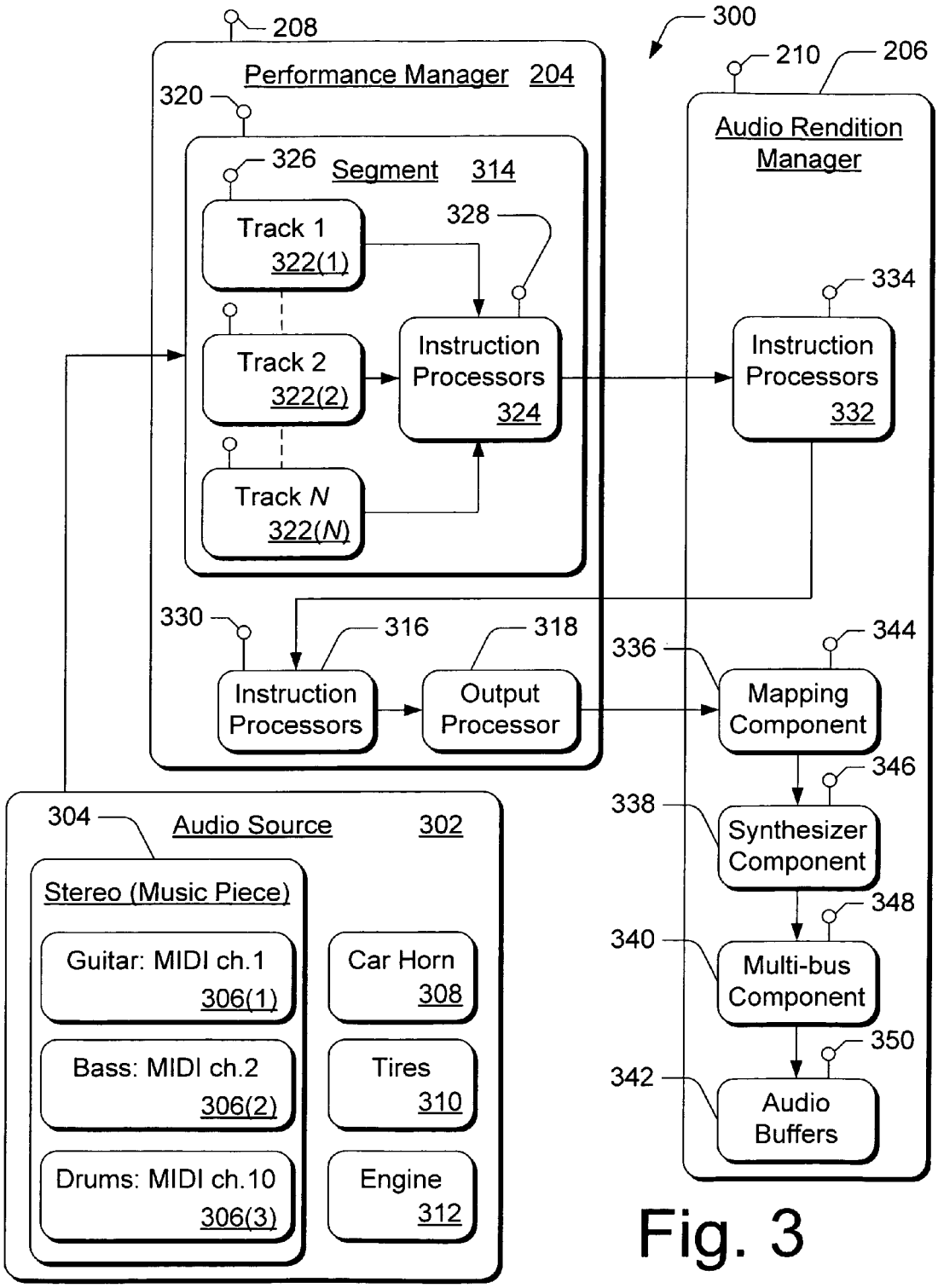
FIG. 3 illustrates various components of the audio generation system shown in FIG. 2.

FIG. 3 illustrates a performance manager 204 and an audio rendition manager 206 as part of an audio generation system 300. An audio source 302 provides sound effects for an audio representation of various sounds that a driver of a car might hear in a video game, for example. The various sound effects can be presented to enhance the perspective of a person sitting in the car for an interactive video and audio presentation.

The audio source 302 has a MIDI formatted music piece 304 that represents the audio of a car stereo. The MIDI input 304 has sound effect instructions 306(1–3) to generate musical instrument sounds. Instruction 306(1) designates that a guitar sound be generated on MIDI channel one (1) in a synthesizer component, instruction 306(2) designates that a bass sound be generated on MIDI channel two (2), and instruction 306(3) designates that drums be generated on MIDI channel ten (10). Input audio source 302 also has digital audio sample inputs that represent a car horn sound effect 308, a tires sound effect 310, and an engine sound effect 312.

The performance manager 204 can receive audio content from a wave file (i.e., .wav file), a MIDI file, or a segment file authored with an audio production application, such as DirectMusic® Producer, for example. DirectMusic® Producer is an authoring tool for creating interactive audio content and is available from Microsoft Corporation of Redmond, Washington. Additionally, performance manager 204 can receive audio content that is composed at run-time from different audio content components.

Performance manager 204 receives audio content input from input audio source 302 and produces audio instructions for input to the audio rendition manager 206. Performance manager 204 includes a segment component 314, an instruction processors component 316, and an output processor 318. The segment component 314 represents the audio content input from audio source 302. Although performance manager 204 is shown having only one segment 314, the performance manager can have a primary segment and any number of secondary segments. Multiple segments can be arranged concurrently and/or sequentially with the performance manager 204.

Segment component 314 can be instantiated as a programming object having one or more interfaces 320 and associated interface methods. In the described embodiment, segment object 314 is an instantiation of a COM object class and represents an audio or musical piece. An audio segment represents a linear interval of audio data or a music piece and is derived from the inputs of an audio source which can be digital audio data, such as the engine sound effect 312 in audio source 302, or event-based data, such as the MIDI formatted input 304.

Segment component 314 has track components 322(1) through 322(N), and an instruction processors component 324. Segment 314 can have any number of track components 322 and can combine different types of audio data in the segment with different track components. Each type of audio data corresponding to a particular segment is contained in a track component 322 in the segment, and an audio segment is generated from a combination of the tracks in the segment. Thus, segment 314 has a track 322 for each of the audio inputs from audio source 302.

Each segment object contains references to one or a plurality of track objects. Track components 322(1) through 322(N) can be instantiated as programming objects having one or more interfaces 326 and associated interface methods. The track objects 322 are played together to render the audio and/or musical piece represented by segment object 314 which is part of a larger overall performance. When first instantiated, a track object does not contain actual music or audio performance data, such as a MIDI instruction sequence. However, each track object has a stream input/output (I/O) interface method through which audio data is specified.

The track objects 322(1) through 322(N) generate event instructions for audio and music generation components when performance manager 204 plays the segment 314. Audio data is routed through the components in the performance manager 204 in the form of event instructions which contain information about the timing and routing of the audio data. The event instructions are routed between and through the components in performance manager 204 on designated performance channels. The performance channels are allocated as needed to accommodate any number of audio input sources and to route event instructions.

To play a particular audio or musical piece, performance manager 204 calls segment object 314 and specifies a time interval or duration within the musical segment. The segment object in turn calls the track play methods of each of its track objects 322, specifying the same time interval. The track objects 322 respond by independently rendering event instructions at the specified interval. This is repeated, designating subsequent intervals, until the segment has finished its playback over the specified duration.

The event instructions generated by a track 322 in segment 314 are input to the instruction processors component 324 in the segment. The instruction processors component 324 can be instantiated as a programming object having one or more interfaces 328 and associated interface methods. The instruction processors component 324 has any number of individual event instruction processors (not shown) and represents the concept of a "graph" that specifies the logical relationship of an individual event instruction processor to another in the instruction processors component. An instruction processor can modify an event instruction and pass it on, delete it, or send a new instruction.

The instruction processors component 316 in performance manager 204 also processes, or modifies, the event instructions. The instruction processors component 316 can be instantiated as a programming object having one or more interfaces 330 and associated interface methods. The event instructions are routed from the performance manager instruction processors component 316 to the output processor 318 which converts the event instructions to MIDI formatted audio instructions. The audio instructions are then routed to audio rendition manager 206.

The audio rendition manager 206 processes audio data to produce one or more instances of a rendition corresponding to an audio source, or audio sources. That is, audio content from multiple sources can be processed and played on a single audio rendition manager 206 simultaneously. Rather than allocating buffer and hardware audio channels for each sound, an audio rendition manager 206 can be instantiated, or otherwise defined, to process multiple sounds from multiple sources.

For example, a rendition of the sound effects in audio source 302 can be processed with a single audio rendition manager 206 to produce an audio representation from a spatialization perspective of inside a car. Additionally, the audio rendition manager 206 dynamically allocates hardware channels (e.g., audio buffers to stream the audio wave data) as needed and can render more than one sound through a single hardware channel because multiple audio events are pre-mixed before being rendered via a hardware channel.

The audio rendition manager 206 has an instruction processors component 332 that receives event instructions from the output of the instruction processors component 324 in segment 314 in the performance manager 204. The instruction processors component 332 in audio rendition manager 206 is also a graph of individual event instruction modifiers that process event instructions. Although not shown, the instruction processors component 332 can receive event instructions from any number of segment outputs. Additionally, the instruction processors component 332 can be instantiated as a programming object having one or more interfaces 334 and associated interface methods.

The audio rendition manager 206 also includes several component objects that are logically related to process the audio instructions received from output processor 318 of performance manager 204. The audio rendition manager 206 has a mapping component 336, a synthesizer component 338, a multi-bus component 340, and an audio buffers component 342.

Mapping component 336 can be instantiated as a programming object having one or more interfaces 344 and associated interface methods. The mapping component 336 maps the audio instructions received from output processor 318 in the performance manager 204 to synthesizer component 338. Although not shown, an audio rendition manager can have more than one synthesizer component. The mapping component 336 communicates audio instructions from multiple sources (e.g., multiple performance channel outputs from output processor 318) for input to one or more synthesizer components 338 in the audio rendition manager 206.

The synthesizer component 338 can be instantiated as a programming object having one or more interfaces 346 and associated interface methods. Synthesizer component 338 receives the audio instructions from output processor 318 via the mapping component 336. Synthesizer component 338 generates audio sound wave data from stored wavetable data in accordance with the received MIDI formatted audio instructions. Audio instructions received by the audio rendition manager 206 that are already in the form of audio wave data are mapped through to the synthesizer component 338, but are not synthesized.

A segment component that corresponds to audio content from a wave file is played by the performance manager 204 like any other segment. The audio data from a wave file is routed through the components of the performance manager on designated performance channels and is routed to the audio rendition manager 206 along with the MIDI formatted audio instructions. Although the audio content from a wave file is not synthesized, it is routed through the synthesizer component 338 and can be processed by MIDI controllers in the synthesizer.

The multi-bus component 340 can be instantiated as a programming object having one or more interfaces 348 and associated interface methods. The multi-bus component 340 routes the audio wave data from the synthesizer component 338 to the audio buffers component 342. The multi-bus component 340 is implemented to represent actual studio audio mixing. In a studio, various audio sources such as instruments, vocals, and the like (which can also be outputs of a synthesizer) are input to a multi-channel mixing board that then routes the audio through various effects (e.g., audio processors), and then mixes the audio into the two channels that are a stereo signal.

The audio buffers component 342 is an audio data buffers manager that can be instantiated or otherwise provided as a programming object or objects having one or more interfaces 350 and associated interface methods. The audio buffers component 342 receives the audio wave data from synthesizer component 338 via the multi-bus component 340. Individual audio buffers, such as a hardware audio channel or a software representation of an audio channel, in the audio buffers component 342 receive the audio wave data and stream the audio wave data in real-time to an audio rendering device, such as a sound card, that produces an audio rendition represented by the audio rendition manager 206 as audible sound.

The various component configurations described herein support COM interfaces for reading and loading the configuration data from a file. To instantiate the components, an application program or a script file instantiates a component using a COM function. The components of the audio generation systems described herein are implemented with COM technology and each component corresponds to an object class and has a corresponding object type identifier or CLSID (class identifier). A component object is an instance of a class and the instance is created from a CLSID using a COM function called CoCreateInstance. However, those skilled in the art will recognize that the audio generation systems and the various components described herein are not limited to a COM implementation, or to any other specific programming technique.

Figure 4:
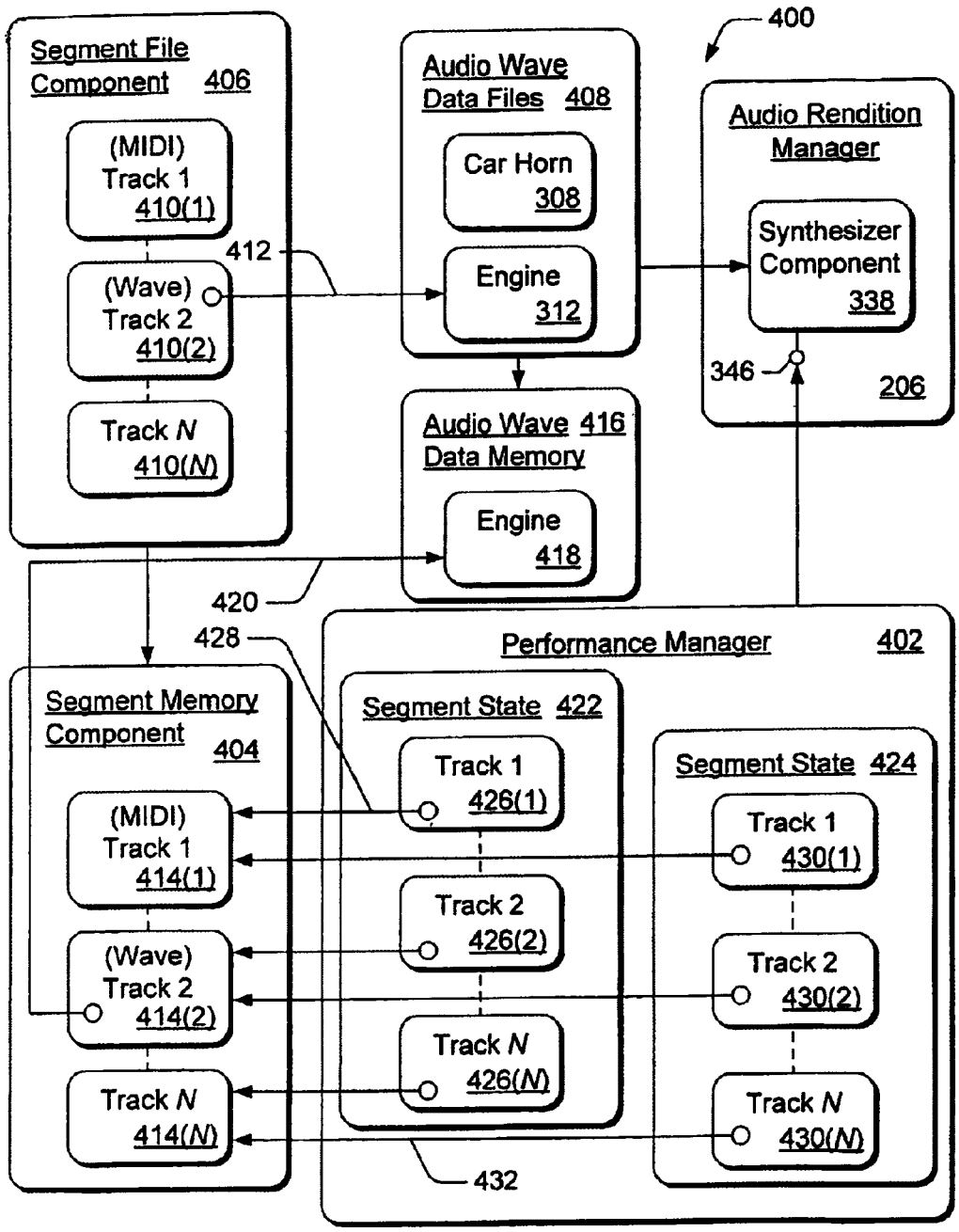
FIG. 4 illustrates various components of the audio generation system shown in FIGS. 2 and 3.

FIG. 4 further illustrates components of an audio generation system 400 that includes a performance manager 402 and a segment component 404. Audio generation system 400 also includes an audio rendition manager 206 and a synthesizer component 338 which is an audio processing component implemented as a programming object having an interface 346 that is callable by another component of the audio generation system. Audio rendition manager 206 and synthesizer component 338 are as described above with reference to audio generation system 300 (FIG. 3).

Audio generation system 400 includes a segment file component 406 that maintains MIDI formatted audio data, and/or references to audio wave files maintained in a memory component of the audio generation system. An audio wave data source 408 includes the car horn sound effect 308 and the engine sound effect 312, both of which are audio wave files. The segment file component 406 includes multiple audio track components 410(1) through 410(N). Audio track component 410(1) is an example of a MIDI audio track component that maintains MIDI formatted audio data, and audio track component 410(2) is an example of an audio wave track component that maintains one or more programming references to audio wave files, such as reference 412 to the tire sound audio wave file 310.

Audio wave data is downloaded to synthesizer component 338 similar to DLS (Downloadable Sounds ) instruments in response to a download interface method call on a segment component. The audio wave data 308 and 312 is downloaded to synthesizer component 338 so that it is available when the synthesizer receives a playback instruction to generate an audio rendition corresponding to the audio wave data. When the audio wave data is downloaded, the audio wave data and associated instruments are routed from audio wave data source 408 to synthesizer component 338 so that the audio wave data and articulation data to render the associated sound is available. Synthesizer component 338 plays the audio waves in a manner similar to playing MIDI notes, and can implement the standard volume, pan, filter, reverb send, and/or other controllers to modulate audio wave data playback.

Segment component 404 is a memory component that represents and instantiation of segment file component 406. The segment component 404 includes multiple audio track components 414(1) through 414(N) that are implemented to manage audio wave data, MIDI audio data, and any number of other audio media types that are played to generate an audio rendition in the audio generation system. Audio wave track components manage audio wave data and maintain a list of programming references (e.g., software pointers) to audio wave data maintained in an audio wave data source. Audio wave track components implement each audio wave as an event which can be created, sent, manipulated, played, and invalidated, just as notes and other performance messages in the audio generation system.

Audio track component 414(1) is implemented as a MIDI track component to manage MIDI audio data from MIDI audio track 410(1) in the segment file component 406. MIDI track component 414(1) generates event instructions that are routed to synthesizer component 338 to generate an audio rendition corresponding to the MIDI audio data. Audio track component 414(2) is implemented as an audio wave track component to manage audio wave data maintained in an audio wave data memory source 416, such as engine sound 418. Audio track component 414(2) references engine sound 418 with a programming reference 420. Audio wave track component 414(2) generates playback instructions that are routed to synthesizer component 338 to generate an audio rendition corresponding to the audio wave data.

Audio wave track components, such as audio wave track component 414(2), manages audio wave data with programming references to audio wave data sources that maintain the audio wave data. This allows the audio wave data to be referenced and repeated in multiple segment components to generate multiple audio renditions corresponding to the audio wave data. For example, an audio wave track component can reference a set of audio wave data files that maintain spoken word waves which can be assembled into sentences using shared and repeated words. Multiple references can also be utilized to manage multiple music waves. With audio wave track components, a composer or sound designer can control the playback of sound effects by creating an elaborate sequence of reference calls to play various sounds.

Performance manager 402 includes a first segment state 422 and a second segment state 424. A segment state represents a playing instance of the performance, and manages initiating segment component 404 to play the audio track components 414. Segment state 422 has audio track components 426(1) through 426(N) with programming references 428 (e.g., software pointers) to each of the audio track components 414 in segment component 404. Similarly, segment state 424 has audio track components 430(1) through 430(N) with programming references 432 to each of the audio track components 414 in segment component 404.

Performance manager 402 illustrates an example of implementing multiple segment states 422 and 424 corresponding to one segment component 404. The audio track components 414 generate playback instructions and/or event instructions for each segment state which are communicated to synthesizer component 338. The synthesizer component generates multiple audio renditions corresponding to the multiple segment states. For example, multiple audio renditions of the MIDI audio data in segment file component 406 and/or of the audio wave data in audio wave data source 408 can represent two different cars in a multimedia application or video game program.

The playback instructions (also referred to herein as "wave performance messages") that are generated by audio wave track components, such as audio wave track component 414(2) in segment component 404, include the start time to render the audio and additional playback information. The playback instructions are generated by the audio wave track components and routed to synthesizer component 338 to play the sound that has been downloaded from audio wave data source 408.

The playback instructions include one or more of the following: one or more programming references to the audio wave data maintained in the audio wave data source 408; a start time to initiate the audio rendition being generated by the audio processing component (e.g., synthesizer component 338); a volume parameter that is a decibel gain applied to the audio wave data; a pitch parameter that identifies an amount that the audio wave data is to be transposed; a variation parameter that identifies whether the audio wave data corresponding to a particular audio track component is to be played; a duration parameter that identifies how long audio wave data corresponding to a particular audio track component will be played; and/or a stop play parameter that stops the audio rendition from being generated.

Figure 5:
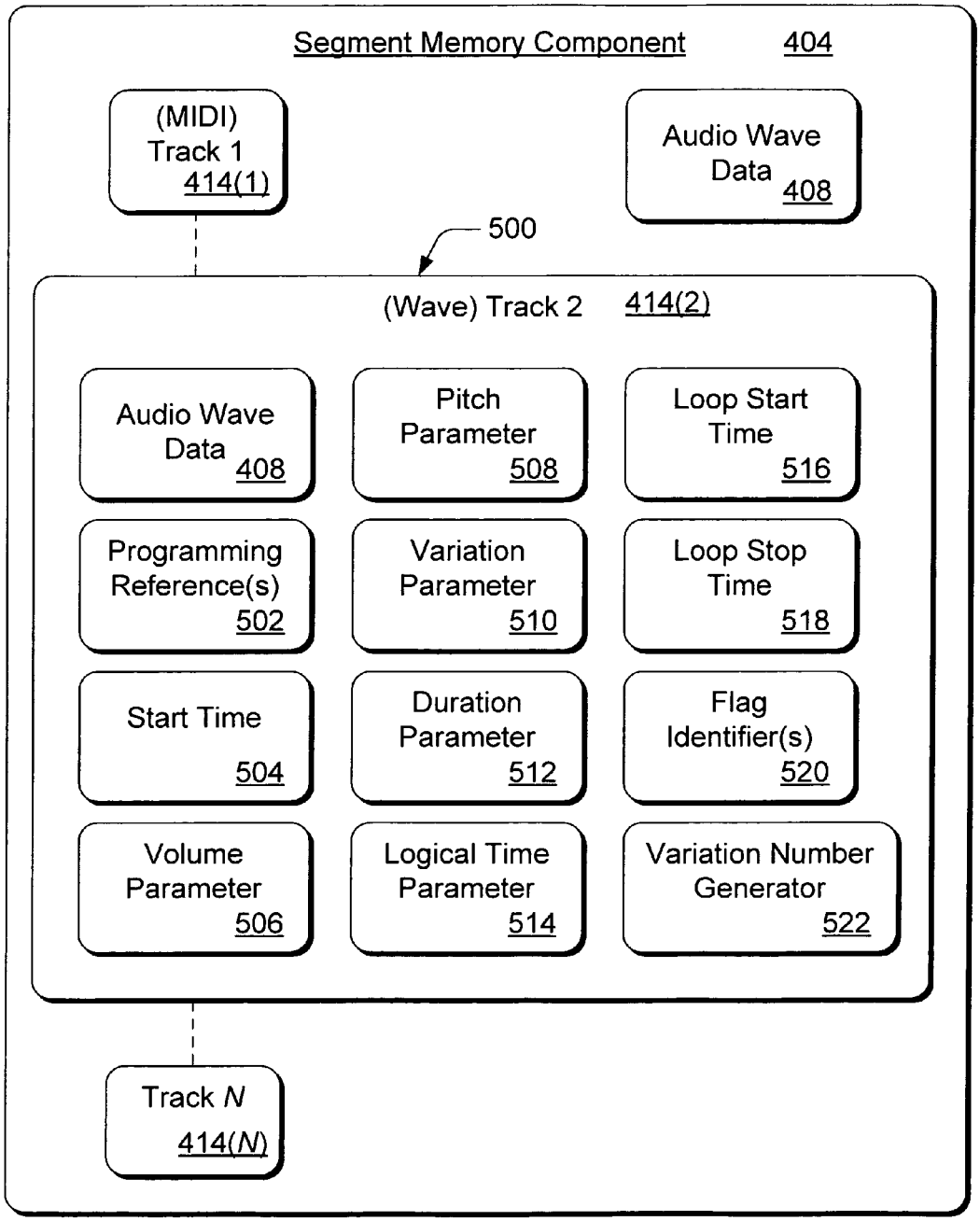
FIG. 5 illustrates various components of the audio generation system shown in FIG. 4.

FIG. 5 further illustrates segment component 404 of audio generation system 400 shown in FIG. 4. Segment component 404 illustrates that audio wave track component 414(2) is implemented as a data structure 500 associated with the segment component. Data structure 500 can include the audio wave data 408 as an embedded audio wave data source. Similarly, segment component 404 can include the audio wave data 408 as an embedded audio wave data source.

The data structure 500 also includes the following: one or more programming references 502 that identify and reference audio wave data in an audio wave data source; a start time 504 that identifies when the audio wave track component is played relative to other audio track components in segment component 404; a volume parameter 506 that is a decibel gain applied to the audio wave data when the audio rendition corresponding to the audio wave data is generated by synthesizer component 338; a pitch parameter 508 that identifies an amount that the audio wave data is to be transposed; a variation parameter 510 that identifies whether the audio wave data corresponding to a particular audio wave track component is to be played; a duration parameter 512 that identifies how long audio wave data corresponding to a particular audio track component will be played; a logical time parameter 514 that indicates a logical start time for the audio wave data; a loop start time 516 that indicates the start time for looping audio wave data; a loop stop time 518 that indicates the stop time for looping audio wave data; one or more flag identifiers 520 that indicate various properties of the wave, such as whether the wave can be invalidated; and a random variation number generator 522 to randomly select a variation number.

When an audio wave track component is initiated to generate playback instructions for audio wave data, the audio wave track component can randomly select a variation number that corresponds to one or more variations of the audio wave data. The segment component plays the one or more audio wave track components that manage audio wave data associated with the selected variation number. With audio wave data variations, different combinations of audio wave data can be selected and/or sequenced so that each performance of the audio wave track can be different. Thus, each time that a segment plays, a different performance is generated. In one implementation, the audio wave track components implement thirty-two (32) variations that are represented by a thirty-two (32) bit field. Each wave reference identifies which variations it belongs to by which of the variation flags are set.

Exemplary Audio Rendition Components

Figure 6:
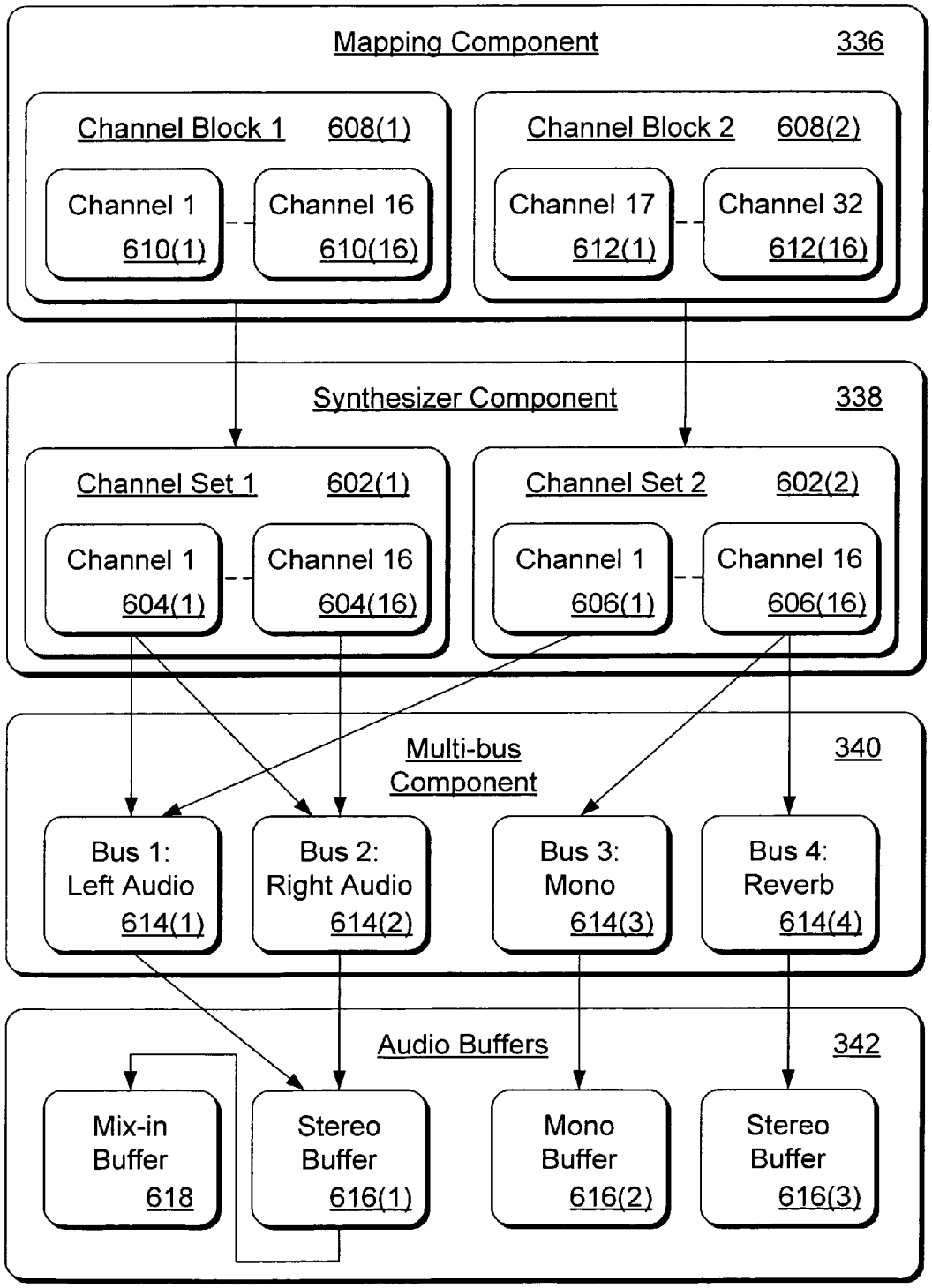
FIG. 6 illustrates various components of the audio generation system shown in FIG. 2.

FIG. 6 illustrates various audio data processing components of the audio rendition manager 206 in accordance with an implementation of the audio generation systems described herein. Details of the mapping component 336, synthesizer component 338, multi-bus component 340, and the audio buffers component 342 (FIG. 3) are illustrated, as well as a logical flow of audio data instructions through the components.

Synthesizer component 338 has two channel sets 602(1) and 602(2), each having sixteen MIDI channels 604(1–16) and 606(1–16), respectively. Those skilled in the art will recognize that a group of sixteen MIDI channels can be identified as channels zero through fifteen (0–15). For consistency and explanation clarity, groups of sixteen MIDI channels described herein are designated in logical groups of one through sixteen (1–16). A synthesizer channel is a communications path in synthesizer component 338 represented by a channel object. A channel object has APIs and associated interface methods to receive and process MIDI formatted audio instructions to generate audio wave data that is output by the synthesizer channels.

To support the MIDI standard, and at the same time make more MIDI channels available in a synthesizer to receive MIDI inputs, channel sets are dynamically created as needed. As many as 65,536 channel sets, each containing sixteen channels, can be created and can exist at any one time for a total of over million available channels in a synthesizer component. The MIDI channels are also dynamically allocated in one or more synthesizers to receive multiple audio instruction inputs. The multiple inputs can then be processed at the same time without channel overlapping and without channel clashing. For example, two MIDI input sources can have MIDI channel designations that designate the same MIDI channel, or channels. When audio instructions from one or more sources designate the same MIDI channel, or channels, the audio instructions are routed to a synthesizer channel 604 or 606 in different channel sets 602(1) or 602(2), respectively.

Mapping component 336 has two channel blocks 608(1) and 608(2), each having sixteen mapping channels to receive audio instructions from output processor 318 in the performance manager 204. The first channel block 608(1) has sixteen mapping channels 610(1–16) and the second channel block 608(2) has sixteen mapping channels 612 (1–16). The channel blocks 608 are dynamically created as needed to receive the audio instructions. The channel blocks 608 each have sixteen channels to support the MIDI standard and the mapping channels are identified sequentially. For example, the first channel block 608(1) has mapping channels one through sixteen (1–16) and the second channel block 608(2) has mapping channels seventeen through thirty-two (17–32). A subsequent third channel block would have sixteen channels thirty-three through forty-eight (33–48).

Each channel block 608 corresponds to a synthesizer channel set 602, and each mapping channel in a channel block maps directly to a synthesizer channel in a synthesizer channel set. For example, the first channel block 608(1) corresponds to the first channel set 602(1) in synthesizer component 338. Each mapping channel 610(1–16) in the first channel block 608(1) corresponds to each of the sixteen synthesizer channels 604(1–16) in channel set 602(1). Additionally, channel block 608(2) corresponds to the second channel set 602(2) in synthesizer component 338. A third channel block can be created in mapping component 336 to correspond to a first channel set in a second synthesizer component (not shown).

Mapping component 336 allows multiple audio instruction sources to share available synthesizer channels, and dynamically allocating synthesizer channels allows multiple source inputs at any one time. Mapping component 336 receives the audio instructions from output processor 318 in the performance manager 204 so as to conserve system resources such that synthesizer channel sets are allocated only as needed. For example, mapping component 336 can receive a first set of audio instructions on mapping channels 610 in the first channel block 608 that designate MIDI channels one (1), two (2), and four (4) which are then routed to synthesizer channels 604(1), 604(2), and 604(4), respectively, in the first channel set 602(1).

When mapping component 336 receives a second set of audio instructions that designate MIDI channels one (1), two (2), three (3), and ten (10), the mapping component routes the audio instructions to synthesizer channels 604 in the first channel set 602(1) that are not currently in use, and then to synthesizer channels 606 in the second channel set 602(2). For example, the audio instruction that designates MIDI channel one (1) is routed to synthesizer channel 606(1) in the second channel set 602(2) because the first MIDI channel 604(1) in the first channel set 602(1) already has an input from the first set of audio instructions. Similarly, the audio instruction that designates MIDI channel two (2) is routed to synthesizer channel 606(2) in the second channel set 602(2) because the second MIDI channel 604(2) in the first channel set 602(1) already has an input. The mapping component 336 routes the audio instruction that designates MIDI channel three (3) to synthesizer channel 604(3) in the first channel set 602(1) because the channel is available and not currently in use. Similarly, the audio instruction that designates MIDI channel ten (10) is routed to synthesizer channel 604(10) in the first channel set 602(1).

When particular synthesizer channels are no longer needed to receive MIDI inputs, the resources allocated to create the synthesizer channels are released as well as the resources allocated to create the channel set containing the synthesizer channels. Similarly, when unused synthesizer channels are released, the resources allocated to create the channel block corresponding to the synthesizer channel set are released to conserve resources.

Multi-bus component 340 has multiple logical buses 614(1–4). A logical bus 614 is a logic connection or data communication path for audio wave data received from synthesizer component 338. The logical buses 614 receive audio wave data from the synthesizer channels 604 and 606 and route the audio wave data to the audio buffers component 342. Although the multi-bus component 340 is shown having only four logical buses 614(1–4), it is to be appreciated that the logical buses are dynamically allocated as needed, and released when no longer needed. Thus, the multi-bus component 340 can support any number of logical buses at any one time as needed to route audio wave data from synthesizer component 338 to the audio buffers component 342.

The audio buffers component 342 includes three buffers 616(1–3) that receive the audio wave data output by synthesizer component 338. The buffers 616 receive the audio wave data via the logical buses 614 in the multi-bus component 340. An audio buffer 616 receives an input of audio wave data from one or more logical buses 614, and streams the audio wave data in real-time to a sound card or similar audio rendering device. An audio buffer 616 can also process the audio wave data input with various effects-processing (i.e., audio data processing) components before sending the data to be further processed and/or rendered as audible sound. The effects processing components are created as part of a buffer 616 and a buffer can have one or more effects processing components that perform functions such as control pan, volume, 3-D spatialization, reverberation, echo, and the like.

The audio buffers component 342 includes three types of buffers. The input buffers 616 receive the audio wave data output by the synthesizer component 338. A mix-in buffer 618 receives data from any of the other buffers, can apply effects processing, and mix the resulting wave forms. For example, mix-in buffer 618 receives an input from input buffer 616(1). Mix-in buffer 618, or mix-in buffers, can be used to apply global effects processing to one or more outputs from the input buffers 616. The outputs of the input buffers 616 and the output of the mix-in buffer 618 are input to a primary buffer (not shown) that performs a final mixing of all of the buffer outputs before sending the audio wave data to an audio rendering device.

The audio buffers component 342 includes a two channel stereo buffer 616(1) that receives audio wave data input from logic buses 614(1) and 614(2), a single channel mono buffer 616(2) that receives audio wave data input from logic bus 614(3), and a single channel reverb stereo buffer 616(3) that receives audio wave data input from logic bus 614(4). Each logical bus 614 has a corresponding bus function identifier that indicates the designated effects-processing function of the particular buffer 616 that receives the audio wave data output from the logical bus. For example, a bus function identifier can indicate that the audio wave data output of a corresponding logical bus will be to a buffer 616 that functions as a left audio channel such as from bus 614(1), a right audio channel such as from bus 614(2), a mono channel such as from bus 614(3), or a reverb channel such as from bus 614(4). Additionally, a logical bus can output audio wave data to a buffer that functions as a three-dimensional (3-D) audio channel, or output audio wave data to other types of effects-processing buffers.

A logical bus 614 can have more than one input, from more than one synthesizer, synthesizer channel, and/or audio source. Synthesizer component 338 can mix audio wave data by routing one output from a synthesizer channel 604 and 606 to any number of logical buses 614 in the multi-bus component 340. For example, bus 614(1) has multiple inputs from the first synthesizer channels 604(1) and 606(1) in each of the channel sets 602(1) and 602(2), respectively. Each logical bus 614 outputs audio wave data to one associated buffer 616, but a particular buffer can have more than one input from different logical buses. For example, buses 614(1) and 614(2) output audio wave data to one designated buffer. The designated buffer 616(1), however, receives the audio wave data output from both buses.

Although the audio buffers component 342 is shown having only three input buffers 616(1–3) and one mix-in buffer 618, it is to be appreciated that there can be any number of audio buffers dynamically allocated as needed to receive audio wave data at any one time. Furthermore, although the multi-bus component 340 is shown as an independent component, it can be integrated with the synthesizer component 338, or with the audio buffers component 342.

File Format and Component Instantiation

Audio sources and audio generation systems can be pre-authored which makes it easy to develop complicated audio representations and generate music and sound effects without having to create and incorporate specific programming code for each instance of an audio rendition of a particular audio source. For example, audio rendition manager 206 (FIG. 3) and the associated audio data processing components can be instantiated from an audio rendition manager configuration data file (not shown).

A segment data file can also contain audio rendition manager configuration data within its file format representation to instantiate audio rendition manager 206. When a segment 414, for example, is loaded from a segment data file, the audio rendition manager 206 is created. Upon playback, the audio rendition manager 206 defined by the configuration data is automatically created and assigned to segment 414. When the audio corresponding to segment 414 is rendered, it releases the system resources allocated to instantiate audio rendition manager 206 and the associated components.

Configuration information for an audio rendition manager object, and the associated component objects for an audio generation system, is stored in a file format such as the Resource Interchange File Format (RIFF). A RIFF file includes a file header that contains data describing the object followed by what are known as "chunks." Each of the chunks following a file header corresponds to a data item that describes the object, and each chunk consists of a chunk header followed by actual chunk data. A chunk header specifies an object class identifier (CLSID) that can be used for creating an instance of the object. Chunk data consists of the data to define the corresponding data item. Those skilled in the art will recognize that an extensible markup language (XML) or other hierarchical file format can be used to implement the component objects and the audio generation systems described herein.

A RIFF file for an audio wave track component has a wave track chunk that includes a volume parameter to define gain characteristics for the audio wave track component, and various general flag identifiers that identify audio wave track component configuration. A wave part file chunk includes a volume parameter to define gain characteristics for the wave part, a variations parameter to define a variation mask which indicates audio wave track components and/or individual audio wave objects that are played together, performance channel identifiers, and flag identifiers that include general information about the wave part, including specifics for managing how variations are chosen.

The RIFF file for an audio wave track component also has a list of individual wave items and includes a wave item chunk for each individual wave item. A wave item chunk includes configuration information about a particular audio wave as well as a reference to the audio wave data. The configuration information includes a volume parameter to define a gain characteristic for the particular audio wave object, a pitch parameter, a variations bit mask to indicate which of the variations the particular audio wave object belongs, a start reference time, a start offset time, a duration parameter, a logical time parameter, loop start and loop end times, and general flag identifiers that indicate whether the particular audio wave object streams audio wave data, and whether the particular audio wave object can be invalidated.

A RIFF file for a mapping component and a synthesizer component has configuration information that includes identifying the synthesizer technology designated by source input audio instructions. An audio source can be designed to play on more than one synthesis technology. For example, a hardware synthesizer can be designated by some audio instructions from a particular source, for performing certain musical instruments for example, while a wavetable synthesizer in software can be designated by the remaining audio instructions for the source.

The configuration information defines the synthesizer channels and includes both a synthesizer channel-to-buffer assignment list and a buffer configuration list stored in the synthesizer configuration data. The synthesizer channel-to-buffer assignment list defines the synthesizer channel sets and the buffers that are designated as the destination for audio wave data output from the synthesizer channels in the channel group. The assignment list associates buffers according to buffer global unique identifiers (GUIDs) which are defined in the buffer configuration list.

The instruction processors, mapping, synthesizer, multibus, and audio buffers component configurations support COM interfaces for reading and loading the configuration data from a file. To instantiate the components, an application program and/or a script file instantiates a component using a COM function. The components of the audio generation systems described herein can be implemented with COM technology and each component corresponds to an object class and has a corresponding object type identifier or CLSID (class identifier). A component object is an instance of a class and the instance is created from a CLSID using a COM function called CoCreateInstance. However, those skilled in the art will recognize that the audio generation systems and the various components described herein are not limited to a COM implementation, or to any other specific programming technique.

To create the component objects of an audio generation system, the application program calls a load method for an object and specifies a RIFF file stream. The object parses the RIFF file stream and extracts header information. When it reads individual chunks, it creates the object components, such as synthesizer channel group objects and corresponding synthesizer channel objects, and mapping channel blocks and corresponding mapping channel objects, based on the chunk header information.

Methods for Audio Wave Data Playback

Although the audio generation systems have been described above primarily in terms of their components and their characteristics, the systems also include methods performed by a computer or similar device to implement the features described above.

Figure 7:
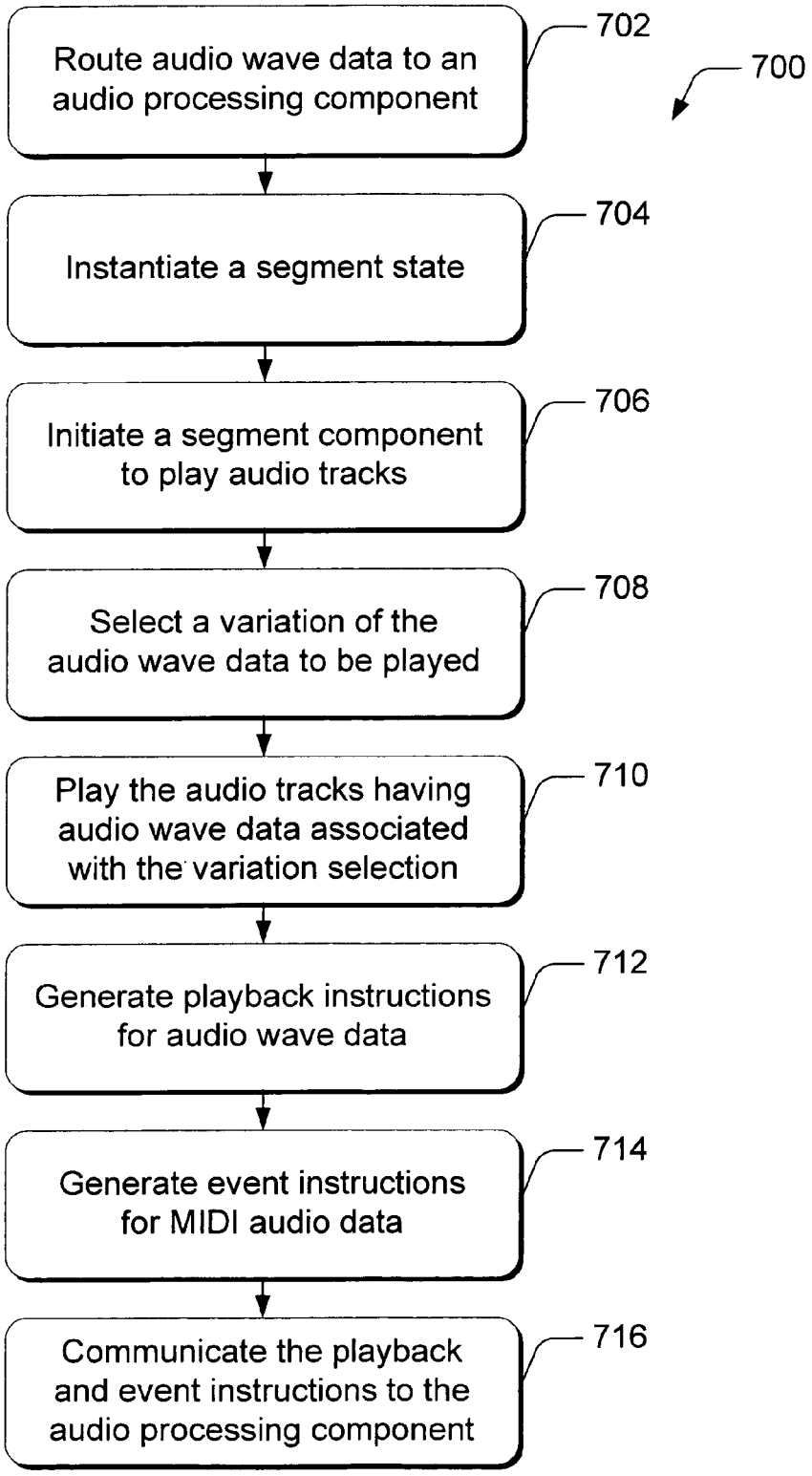
FIG. 7 is a flow diagram for audio wave data playback in an audio generation system.

FIG. 7 illustrates a method 700 for playing audio wave data in an audio generation system. The method is illustrated as a set of operations shown as discrete blocks, and the order in which the method is described is not intended to be construed as a limitation. Furthermore, the method can be implemented in any suitable hardware, software, firmware, or combination thereof.

At block 702, audio wave data is routed to an audio processing component from one or more audio wave data sources. For example, synthesizer component 338 receives audio wave data from audio wave data source 408.

At block 704, a segment state is instantiated that initiates a segment component to play audio tracks. For example, segment state 422 is instantiated in performance manager 402 to initiate segment component 404 playing the audio tracks 414. Further, multiple segment states can be instantiated at the same time. For example, segment state 424 is also instantiated in performance manager 402 to initiate segment component 404 playing the audio tracks 414.

At block 706, a segment component is initiated to play one or more audio wave track components and/or one or more MIDI track components. For example, segment component 404 is initiated by segment state 422 to play MIDI track component 414(1) and audio wave track component 414(2).

At block 708, a variation number corresponding to one or more variations of the audio wave data is selected. For example, audio wave track component 414(2) (FIG. 5) includes a random variation number generator 522 to randomly select a variation number (e.g., one to thirty-two of a thirty-two bit field). At block 710, one or more audio wave track components corresponding to audio wave data associated with the variation number are played.

At block 712, playback instructions for the audio wave data are generated with the one or more audio wave track components. For example, audio track component 414(2) of segment component 404 is an audio wave track component that generates playback instructions for audio wave data associated with the audio wave track component 414(2). For multiple segment states, such as segment states 422 and 424 in performance manager 402, playback instructions and event instructions are generated for each segment state.

At block 714, event instructions for MIDI audio data are generated with the one or more MIDI track components. For example, audio track component 414(1) of segment component 404 is a MIDI track component that generates event instructions for MIDI audio data associated with the MIDI track component 414(1).

At block 716, the playback instructions and the event instructions are communicated to the audio processing component that generates an audio rendition corresponding to the audio wave data and/or the MIDI audio data. For example, synthesizer component 338 receives the playback instructions generated by audio wave track component 414 (2) in segment component 404. Synthesizer component 338 also receives the event instructions generated by MIDI track component 414(1) in segment component 404.

For multiple segment states, such as segment states 422 and 424 in performance manager 402, playback instructions and/or event instructions for each segment state are communicated to synthesizer component 338 such that the synthesizer component generates multiple audio renditions corresponding to the multiple segment states. Further, the audio generation system can include multiple audio processing components that each receive the playback instructions and/or the event instructions, and each audio processing component generates an audio rendition corresponding to the audio wave data and/or the MIDI audio data.

Audio Generation System Component Interfaces and Methods

Embodiments of the invention are described herein with emphasis on the functionality and interaction of the various components and objects. The following sections describe specific interfaces and interface methods that are supported by the various objects.

A Loader interface (IDirectMusicLoader8) is an object that gets other objects and loads audio rendition manager configuration information. It is generally one of the first objects created in a DirectX® audio application. DirectX® is an API available from Microsoft Corporation, Redmond Wash. The loader interface supports a LoadObjectFromFile method that is called to load all audio content, including DirectMusic® segment files, DLS (downloadable sounds) collections, MIDI files, and both mono and stereo wave files. It can also load data stored in resources. Component objects are loaded from a file or resource and incorporated into a performance. The Loader interface is used to manage the enumeration and loading of the objects, as well as to cache them so that they are not loaded more than once.

Audio Rendition Manager Interface and Methods

An AudioPath interface (IDirectMusicAudioPath8) represents the routing of audio data from a performance component to the various component objects that comprise an audio rendition manager. The AudioPath interface includes the following methods:

An Activate method is called to specify whether to activate or deactivate an audio rendition manager. The method accepts Boolean parameters that specify "TRUE" to activate, or "FALSE" to deactivate.

A ConvertPChannel method translates between an audio data channel in a segment component and the equivalent performance channel allocated in a performance manager for an audio rendition manager. The method accepts a value that specifies the audio data channel in the segment component, and an address of a variable that receives a designation of the performance channel.

A SetVolume method is called to set the audio volume on an audio rendition manager. The method accepts parameters that specify the attenuation level and a time over which the volume change takes place.

A GetObjectInPath method allows an application program to retrieve an interface for a component object in an audio rendition manager. The method accepts parameters that specify a performance channel to search, a representative location for the requested object in the logical path of the audio rendition manager, a CLSID (object class identifier), an index of the requested object within a list of matching objects, an identifier that specifies the requested interface of the object, and the address of a variable that receives a pointer to the requested interface.

The GetObjectInPath method is supported by various component objects of the audio generation system. The audio rendition manager, segment component, and audio buffers in the audio buffers component, for example, each support the getObject interface method that allows an application program to access and control the audio data processing component objects. The application program can get a pointer, or programming reference, to any interface (API) on any component object in the audio rendition manager while the audio data is being processed.

Real-time control of audio data processing components is needed, for example, to control an audio representation of a video game presentation when parameters that are influenced by interactivity with the video game change, such as a video entity's 3-D positioning in response to a change in a video game scene. Other examples include adjusting audio environment reverb in response to a change in a video game scene, or adjusting music transpose in response to a change in the emotional intensity of a video game scene.

Performance Manager Interface and Methods

A Performance interface (IDirectMusicPerformance8) represents a performance manager and the overall management of audio and music playback. The interface is used to add and remove synthesizers, map performance channels to synthesizers, play segments, dispatch event instructions and route them through event instructions, set audio parameters, and the like. The Performance interface includes the following methods:

A CreateAudioPath method is called to create an audio rendition manager object. The method accepts parameters that specify an address of an interface that represents the audio rendition manager configuration data, a Boolean value that specifies whether to activate the audio rendition manager when instantiated, and the address of a variable that receives an interface pointer for the audio rendition manager.

A CreateStandardAudioPath method allows an application program to instantiate predefined audio rendition managers rather than one defined in a source file. The method accepts parameters that specify the type of audio rendition manager to instantiate, the number of performance channels for audio data, a Boolean value that specifies whether to activate the audio rendition manager when instantiated, and the address of a variable that receives an interface pointer for the audio rendition manager.

A PlaySegmentEx method is called to play an instance of a segment on an audio rendition manager. The method accepts parameters that specify a particular segment to play, various flags, and an indication of when the segment instance should start playing. The flags indicate details about how the segment should relate to other segments and whether the segment should start immediately after the specified time or only on a specified type of time boundary. The method returns a memory pointer to the state object that is subsequently instantiated as a result of calling PlaySegmentEx.

A StopEx method is called to stop the playback of audio on an component object in an audio generation system, such as a segment or an audio rendition manager. The method accepts parameters that specify a pointer to an interface of the object to stop, a time at which to stop the object, and various flags that indicate whether the segment should be stopped on a specified type of time boundary.

Segment Component Interface and Methods

A Segment interface (IDirectMusicSegment8) represents a segment in a performance manager which is comprised of multiple tracks. The Segment interface includes the following methods:

A Download method to download audio data to a performance manager or to an audio rendition manager. The term "download" indicates reading audio data from a source into memory. The method accepts a parameter that specifies a pointer to an interface of the performance manager or audio rendition manager that receives the audio data.

An Unload method to unload audio data from a performance manager or an audio rendition manager. The term "unload" indicates releasing audio data memory back to the system resources. The method accepts a parameter that specifies a pointer to an interface of the performance manager or audio rendition manager.

A GetAudioPathConfig method retrieves an object that represents audio rendition manager configuration data embedded in a segment. The object retrieved can be passed to the CreateAudioPath method described above. The method accepts a parameter that specifies the address of a variable that receives a pointer to the interface of the audio rendition manager configuration object.

Segment Component Interface and Methods

A Track interface (IDirectMusicTrack) represents an audio data track component in a segment component. The Track interface includes the following methods:

An Initialize method is called by the segment object to initialize a track object after creating it. This method does not load music performance data. Rather, music performance data is loaded through the IPersistStream interface. The group and index assignments of the new track object are specified as arguments to this method.

An InitPlay method is called prior to beginning the playback of a track. This allows the track object to open and initialize internal state variables and data structures used during playback. Some track objects can use this to trigger specific operations. For example, a track that manages the downloading of configuration information can download the information in response to its InitPlay method being called.

An EndPlay method is called by a segment object upon finishing the playback of a track. This allows the track object to close any internal state variables and data structures used during playback. A track that manages the downloading of configuration information can unload the information in response to its EndPlay method being called.

A Play method accepts arguments corresponding to a start time, an end time, and an offset within the music performance data. When this method is called, the track object renders the music defined by the start and end times. For example, a note sequence track would render stored notes, a lyric track would display words, and an algorithmic music track would generate a range of notes. The offset indicates the position in the overall performance relative to which the start and end times are to be interpreted.

A Clone method causes the track object to make an identical copy of itself. The method accepts start and end times so that a specified piece of the track can be duplicated.

Exemplary Computing System and Environment

Figure 8:
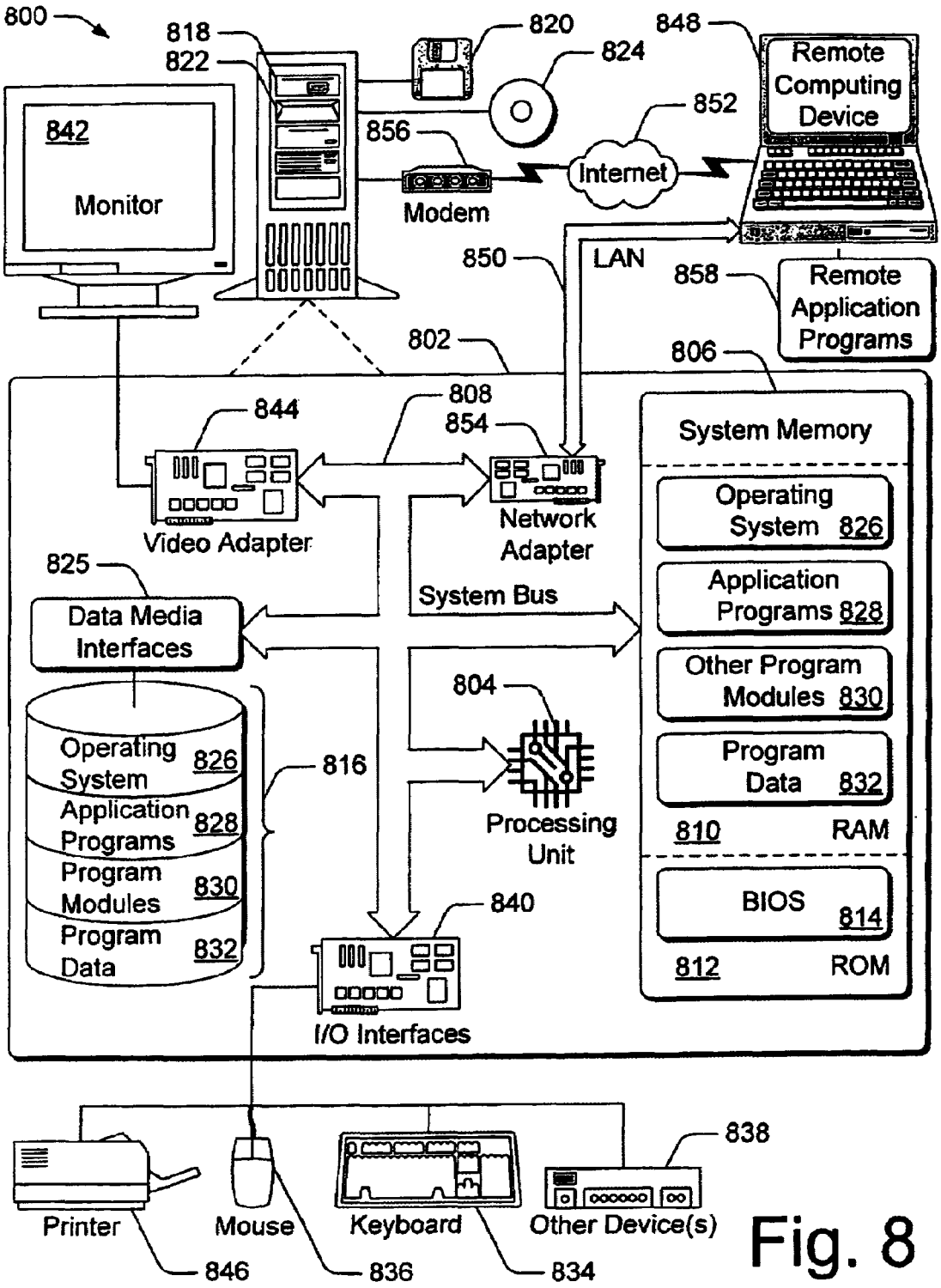
FIG. 8 is a diagram of computing systems, devices, and components in an environment that can be used to implement the systems and methods described herein.

FIG. 8 illustrates an example of a computing environment 800 within which the computer, network, and system architectures described herein can be either fully or partially implemented. Exemplary computing environment 800 is only one example of a computing system and is not intended to suggest any limitation as to the scope of use or functionality of the network architectures. Neither should the computing environment 800 be interpreted as having any dependency or requirement relating to any one or combination of components illustrated in the exemplary computing environment 800.

The computer and network architectures can be implemented with numerous other general purpose or special purpose computing system environments or configurations. Examples of well known computing systems, environments, and/or configurations that may be suitable for use include, but are not limited to, personal computers, server computers, thin clients, thick clients, hand-held or laptop devices, multiprocessor systems, microprocessor-based systems, set top boxes, programmable consumer electronics, network PCs, minicomputers, mainframe computers, gaming consoles, distributed computing environments that include any of the above systems or devices, and the like.

Audio generation may be described in the general context of computer-executable instructions, such as program modules, being executed by a computer. Generally, program modules include routines, programs, objects, components, data structures, etc. that perform particular tasks or implement particular abstract data types. Audio generation may also be practiced in distributed computing environments where tasks are performed by remote processing devices that are linked through a communications network. In a distributed computing environment, program modules may be located in both local and remote computer storage media including memory storage devices.

The computing environment 800 includes a general-purpose computing system in the form of a computer 802. The components of computer 802 can include, by are not limited to, one or more processors or processing units 804, a system memory 806, and a system bus 808 that couples various system components including the processor 804 to the system memory 806.

The system bus 808 represents one or more of any of several types of bus structures, including a memory bus or memory controller, a peripheral bus, an accelerated graphics port, and a processor or local bus using any of a variety of bus architectures. By way of example, such architectures can include an Industry Standard Architecture (ISA) bus, a Micro Channel Architecture (MCA) bus, an Enhanced ISA (EISA) bus, a Video Electronics Standards Association (VESA) local bus, and a Peripheral Component Interconnects (PCI) bus also known as a Mezzanine bus.

Computer system 802 typically includes a variety of computer readable media. Such media can be any available media that is accessible by computer 802 and includes both volatile and non-volatile media, removable and non-removable media. The system memory 806 includes computer readable media in the form of volatile memory, such as random access memory (RAM) 810, and/or non-volatile memory, such as read only memory (ROM) 812. A basic input/output system (BIOS) 814, containing the basic routines that help to transfer information between elements within computer 802, such as during start-up, is stored in ROM 812. RAM 810 typically contains data and/or program modules that are immediately accessible to and/or presently operated on by the processing unit 804.

Computer 802 can also include other removable/non-removable, volatile/non-volatile computer storage media. By way of example, FIG. 8 illustrates a hard disk drive 816 for reading from and writing to a non-removable, non-volatile magnetic media (not shown), a magnetic disk drive 818 for reading from and writing to a removable, non-volatile magnetic disk 820 (e.g., a "floppy disk"), and an optical disk drive 822 for reading from and/or writing to a removable, non-volatile optical disk 824 such as a CD-ROM, DVD-ROM, or other optical media. The hard disk drive 816, magnetic disk drive 818, and optical disk drive 822 are each connected to the system bus 808 by one or more data media interfaces 825. Alternatively, the hard disk drive 816, magnetic disk drive 818, and optical disk drive 822 can be connected to the system bus 808 by a SCSI interface (not shown).

The disk drives and their associated computer-readable media provide non-volatile storage of computer readable instructions, data structures, program modules, and other data for computer 802. Although the example illustrates a hard disk 816, a removable magnetic disk 820, and a removable optical disk 824, it is to be appreciated that other types of computer readable media which can store data that is accessible by a computer, such as magnetic cassettes or other magnetic storage devices, flash memory cards, CD-ROM, digital versatile disks (DVD) or other optical storage, random access memories (RAM), read only memories (ROM), electrically erasable programmable read-only memory (EEPROM), and the like, can also be utilized to implement the exemplary computing system and environment.

Any number of program modules can be stored on the hard disk 816, magnetic disk 820, optical disk 824, ROM 812, and/or RAM 810, including by way of example, an operating system 826, one or more application programs 828, other program modules 830, and program data 832. Each of such operating system 826, one or more application programs 828, other program modules 830, and program data 832 (or some combination thereof) may include an embodiment of an audio generation system.

Computer system 802 can include a variety of computer readable media identified as communication media. Communication media typically embodies computer readable instructions, data structures, program modules, or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared, and other wireless media. Combinations of any of the above are also included within the scope of computer readable media.

A user can enter commands and information into computer system 802 via input devices such as a keyboard 834 and a pointing device 836 (e.g., a "mouse"). Other input devices 838 (not shown specifically) may include a microphone, joystick, game pad, satellite dish, serial port, scanner, and/or the like. These and other input devices are connected to the processing unit 804 via input/output interfaces 840 that are coupled to the system bus 808, but may be connected by other interface and bus structures, such as a parallel port, game port, or a universal serial bus (USB).

A monitor 842 or other type of display device can also be connected to the system bus 808 via an interface, such as a video adapter 844. In addition to the monitor 842, other output peripheral devices can include components such as speakers (not shown) and a printer 846 which can be connected to computer 802 via the input/output interfaces 840.

Computer 802 can operate in a networked environment using logical connections to one or more remote computers, such as a remote computing device 848. By way of example, the remote computing device 848 can be a personal computer, portable computer, a server, a router, a network computer, a peer device or other common network node, and the like. The remote computing device 848 is illustrated as a portable computer that can include many or all of the elements and features described herein relative to computer system 802.

Logical connections between computer 802 and the remote computer 848 are depicted as a local area network (LAN) 850 and a general wide area network (WAN) 852. Such networking environments are commonplace in offices, enterprise-wide computer networks, intranets, and the Internet. When implemented in a LAN networking environment, the computer 802 is connected to a local network 850 via a network interface or adapter 854. When implemented in a WAN networking environment, the computer 802 typically includes a modem 856 or other means for establishing communications over the wide network 852. The modem 856, which can be internal or external to computer 802, can be connected to the system bus 808 via the input/output interfaces 840 or other appropriate mechanisms. It is to be appreciated that the illustrated network connections are exemplary and that other means of establishing communication link(s) between the computers 802 and 848 can be employed.

In a networked environment, such as that illustrated with computing environment 800, program modules depicted relative to the computer 802, or portions thereof, may be stored in a remote memory storage device. By way of example, remote application programs 858 reside on a memory device of remote computer 848. For purposes of illustration, application programs and other executable program components, such as the operating system, are illustrated herein as discrete blocks, although it is recognized that such programs and components reside at various times in different storage components of the computer system 802, and are executed by the data processor(s) of the computer.

CONCLUSION

Although the systems and methods have been described in language specific to structural features and/or procedures, it is to be understood that the invention defined in the appended claims is not necessarily limited to the specific features or procedures described. Rather, the specific features and procedures are disclosed as preferred forms of implementing the claimed invention.

The invention claimed is:

1. An audio generation system, comprising:

an audio processing component configured to generate an audio rendition corresponding to audio wave data derived from multiple audio wave data sources, the audio rendition including an audible playback according to playback instructions;

audio wave track components configured to generate the playback instructions that are routed to the audio processing component to initiate the audio rendition being generated;

a segment component configured to play the audio wave track components to generate the playback instructions for the audio rendition; and an audio rendition manager that includes the audio processing component which generates the audio rendition as streams of audio wave data, the audio rendition manager further including audio buffers to process the audio wave data, and logical buses that each correspond to one of the audio buffers, where each of the multiple streams of audio wave data are assigned to one or more of the logical buses such that a logical bus receives one or more of the streams of audio wave data from the audio processing component and routes the streams of audio wave data to the corresponding audio buffer.

2. An audio generation system as recited in claim 1, further comprising MIDI track components configured to generate event instructions that are routed to the audio processing component to initiate a second audio rendition corresponding to MIDI audio data, and wherein the segment component is further configured to play one or more of the MIDI track components to generate the event instructions.

3. An audio generation system as recited in claim 1, further comprising a segment state that includes programming references to each of the audio wave track components, the segment state configured to initiate that the audio wave track components generate the playback instructions.

4. An audio generation system as recited in claim 1, further comprising one or more segment states that include programming references to each of the audio wave track components, the one or more segment states configured to initiate that the audio wave track components generate the playback instructions such that the audio processing component generates one or more audio renditions corresponding to the audio wave data.

5. An audio generation system as recited in claim 1, further comprising a performance manager that includes one or more segment states, each segment state including programming references to each of the audio wave track components, and each segment state configured to initiate that the audio wave track components generate the playback instructions.

6. An audio generation system as recited in claim 1, further comprising one or more performance managers that each include a segment state having programming references to each of the audio wave track components, the segment state configured to initiate that the audio wave track components generate the playback instructions.

7. An audio generation system as recited in claim 1, wherein the audio processing component is further configured to receive the playback instructions from the audio wave track components.

8. An audio generation system as recited in claim 1, wherein the audio processing component is a synthesizer component configured to receive the audio wave data from the multiple audio wave data sources, and is further configured to generate the audio rendition in response to the playback instructions.

9. An audio generation system as recited in claim 1, further comprising at least a second audio processing component configured to receive the playback instructions from the audio wave track components, the second audio processing component further configured to generate a second audio rendition corresponding to the audio wave data.

10. An audio generation system as recited in claim 1, wherein the audio wave track components are further configured to maintain the audio wave data as an embedded audio wave data source.

11. An audio generation system as recited in claim 1, wherein the segment component is further configured to maintain the audio wave data as an embedded audio wave data source.

12. An audio generation system as recited in claim 1, wherein the audio wave track components are further configured to randomly select a variation of the audio wave data such that the segment component plays the audio wave track components that correspond to the variation selection.

13. An audio generation system as recited in claim 1, wherein the audio wave track components include programming references to variations of the audio wave data, and wherein the audio wave track components are further configured to randomly select a variation of the audio wave data such that the segment component plays the audio wave track components that correspond to the variation.

14. An audio generation system as recited in claim 1, wherein the segment component is a programming object having an interface that is callable by a software component of the audio generation system to initiate that the segment component play the audio wave track components.

15. An audio generation system as recited in claim 1, wherein the segment component is a programming object having an interface that is callable by a performance manager to initiate that the segment component play the audio wave track components, and wherein the audio wave track components are programming objects each having an interface that is callable by the segment component to initiate that the audio wave track components generate the playback instructions.

16. An audio generation system as recited in claim 1, wherein the audio wave track components generate the playback instructions to include one or more of the following:

one or more programming references to the audio wave data;

a start time to initiate the audio rendition being generated;

a volume parameter that is a decibel gain applied to the audio wave data;

a pitch parameter that identifies an amount that the audio wave data is to be transposed;

a variation parameter that identifies whether the audio wave data corresponding to a particular audio wave track component is to be played;

a duration parameter that identifies how long audio wave data corresponding to a particular audio wave track component will be played; and a stop play parameter that stops the audio rendition from being generated.

17. An audio generation system as recited in claim 1, wherein the audio wave track components are implemented as data structures associated with the segment component, an individual data structure for an audio wave track component including one or more of the following:

one or more programing references that identify the audio wave data;

a start time that identifies when the audio wave track component is played relative to other audio wave track components;

a volume parameter that is a decibel gain applied to the audio wave data;

a pitch parameter that identifies an amount that the audio wave data is to be transposed;

a variation parameter that identifies whether the audio wave data corresponding to a particular audio wave track component is to be played; and a duration parameter that identifies how long audio wave data corresponding to a particular audio wave track component will be played.

18. An audio generation system, comprising:

a MIDI track component configured to generate event instructions for MIDI audio data received from a MIDI audio data source;

an audio wave track component configured to generate playback instructions for audio wave data received from multiple audio wave data sources;

a segment component configured to play the MIDI track component to generate the event instructions, and further configured to play the audio wave track component to generate the playback instructions;

an audio processing component configured to receive the event instructions and the playback instructions, and further configured to generate an audio rendition that is an audible playback of the MIDI audio data and the audio wave data; and an audio rendition manager that includes the audio processing component which generates the audio rendition as streams of audio wave data, the audio rendition manager further including audio buffers to process the audio wave data, and logical buses that each correspond to one of the audio buffers, where each of the multiple streams of audio wave data are assigned to one or more of the logical buses such that a logical bus receives one or more of the streams of audio wave data from the audio processing component and routes the streams of audio wave data to the corresponding audio buffer.

19. An audio generation system as recited in claim 18, wherein the segment component includes the MIDI track component and the audio wave track component.

20. An audio generation system as recited in claim 18, wherein the segment component includes the MIDI track component, the audio wave track component, and one or more of the following:

one or more additional MIDI track components configured to generate additional event instructions for additional MIDI audio data received from one or more MIDI audio data sources; and one or more additional audio wave track components configured to generate additional playback instructions for additional audio wave data maintained in one or more audio wave data sources.

21. An audio generation system as recited in claim 18, further comprising a segment state that includes a first programming reference to the MIDI track component and a second programming reference to the audio wave track component, the segment state configured to initiate that the MIDI track component generate the event instructions, and further configured to initiate that the audio wave track component generate the playback instructions.

22. An audio generation system as recited in claim 18, further comprising one or more segment states that include a first programming reference to the MIDI track component and a second programming reference to the audio wave track component, the one or more segment states configured to initiate that the MIDI track component generate the event instructions, and further configured to initiate that the audio wave track component generate the playback instructions such that the audio processing component generates one or more audio renditions corresponding to the MIDI audio data and to the audio wave data.

23. An audio generation system as recited in claim 18, further comprising a performance manager that includes one or more segment states, each segment state including a first programming reference to the MIDI track component and a second programming reference to the audio wave track component, the one or more segment states configured to initiate that the MIDI track component generate the event instructions, and further configured to initiate that the audio wave track component generate the playback instructions.

24. An audio generation system as recited in claim 18, wherein the audio processing component is a synthesizer component configured to receive the audio wave data from the multiple audio wave data sources.

25. An audio generation system as recited in claim 18, further comprising at least a second audio processing component configured to:

receive the audio wave data from the multiple audio wave data sources;

receive the event instructions and the playback instructions; and generate a second audio rendition that is a second audible playback of the MIDI audio data and the audio wave data.

26. An audio generation system as recited in claim 18, wherein the audio wave track component is further configured to maintain the audio wave data as an embedded audio wave data source.

27. An audio generation system as recited in claim 18, wherein the segment component is further configured to maintain the audio wave data as an embedded audio wave data source.

28. An audio generation system as recited in claim 18, wherein the audio wave track component is further configured to randomly select a variation of the audio wave data when the audio wave track component is played.

29. An audio generation system as recited in claim 18, wherein the audio wave track component is further configured to randomly select a variation of the audio wave data such that the segment component plays audio wave data in the audio wave track component that corresponds to the variation selection.

30. An audio generation system as recited in claim 18, wherein the audio wave track component includes programming references to variations of the audio wave data maintained in the multiple audio wave data sources, and wherein the audio wave track component is further configured to randomly select a variation of the audio wave data when the audio wave track component is played.

31. An audio generation system as recited in claim 18, wherein the segment component is a programming object having an interface that is callable by a software component of the audio generation system to initiate that the segment component play the MIDI track component and play the audio wave track component.

32. An audio generation system as recited in claim 18, wherein:

the segment component is a programming object having an interface that is callable by a performance manager to initiate that the segment component play the MIDI track component and play the audio wave track component;

the MIDI track component is a programming object having an interface that is callable by the segment component to initiate that the MIDI track component generate the event instructions; and the audio wave track component is a programming object having an interface that is callable by the segment component to initiate that the audio wave track component generate the playback instructions.

33. An audio generation system as recited in claim 18, wherein the audio wave track component generates the playback instructions to include one or more of the following:

one or more programming references to the audio wave data;

a start time to initiate the audio rendition being generated;

a volume parameter that is a decibel gain applied to the audio wave data;

a pitch parameter that identifies an amount that the audio wave data is to be transposed;

a variation parameter that identifies whether the audio wave data corresponding to the audio wave track component is to be played;

a duration parameter that identifies how long audio wave data corresponding to the audio wave track component will be played; and a stop play parameter that stops the audio rendition from being generated.

34. An audio generation system as recited in claim 18, wherein the audio wave track component is implemented as a data structure associated with the segment component, the data structure including one or more of the following:

one or more programming references that identify the audio wave data;

a start time that identifies when the audio wave track component is played relative to the MIDI track component and to other audio wave track components;

a volume parameter that is a decibel gain applied to the audio wave data;

a pitch parameter that identifies an amount that the audio wave data is to be transposed;

a variation parameter that identifies whether the audio wave data corresponding to the audio wave track component is to be played; and a duration parameter that identifies how long audio wave data corresponding to the audio wave track component will be played.

35. A method, comprising:

initiating a segment component to play audio wave track components that generate playback instructions for audible playback of an audio rendition;

generating the playback instructions for audio wave data with the audio wave track components, the audio wave data derived from multiple audio wave data sources;

communicating the playback instructions to an audio processing component that generates the audio rendition corresponding to the audio wave data; and instantiating an audio rendition manager that includes the audio processing component which generates the audio rendition as streams of audio wave data, the audio rendition manager further including audio buffers to process the audio wave data, and logical buses that each correspond to one of the audio buffers, where each of the multiple streams of audio wave data are assigned to one or more of the logical buses such that a logical bus receives one or more of the streams of audio wave data from the audio processing component and routes the streams of audio wave data to the corresponding audio buffer.

36. A method as recited in claim 35, further comprising routing the audio wave data to the audio processing component from the multiple audio wave data sources.

37. A method as recited in claim 35, further comprising routing the audio wave data to the audio processing component from the multiple audio wave data sources before generating the playback instructions.

38. A method as recited in claim 35, further comprising instantiating a segment state that initiates the segment component playing the audio wave track components.

39. A method as recited in claim 35, further comprising instantiating multiple segment states that each initiate the segment component playing the audio wave track components, and wherein:

generating the playback instructions includes generating playback instructions for each segment state; and communicating the playback instructions includes communicating the playback instructions for each segment state to the audio processing component such that the audio processing component generates multiple audio renditions corresponding to the multiple segment states.

40. A method as recited in claim 35, further comprising selecting a variation number corresponding to one or more variations of the audio wave data, and further comprising playing the audio wave track components corresponding to audio wave data associated with the variation number.

41. A method as recited in claim 35, wherein communicating the playback instructions includes communicating the playback instructions to multiple audio processing components that each generate an audio rendition corresponding to the audio wave data.

42. A method as recited in claim 35, further comprising:

initiating the segment component to play one or more MIDI track components;

generating event instructions for MIDI audio data with the one or more MIDI track components; and wherein communicating the playback instructions includes communicating the event instructions to the audio processing component to generate the audio rendition corresponding to the audio wave data and to the MIDI audio data.

43. One or more computer-readable media comprising computer-executable instructions that, when executed, direct an audio generation system to perform the method of claim 35.

44. One or more computer-readable media comprising computer-executable instructions that, when executed, direct an audio generation system to perform the method of claim 42.

45. A method, comprising:

generating playback instructions for audio wave data with an audio wave track component;

generating event instructions for MIDI audio data with a MIDI track component;

communicating the playback instructions and the event instructions to an audio processing component that generates an audio rendition which is an audible playback of the audio wave data and the MIDI audio data; and instantiating an audio rendition manager that includes the audio processing component which generates the audio rendition as streams of audio wave data, the audio rendition manager further including audio buffers to process the audio wave data, and logical buses that each correspond to one of the audio buffers, where each of the multiple streams of audio wave data are assigned to one or more of the logical buses such that a logical bus receives one or more of the streams of audio wave data from the audio processing component and routes the streams of audio wave data to the corresponding audio buffer.

46. A method as recited in claim 45, further comprising requesting an allocation of logical communication paths in the audio processing component to route the playback instructions and the event instructions.

47. A method as recited in claim 45, further comprising routing the audio wave data to the audio processing component from multiple audio wave data sources before communicating the playback instructions.

48. A method recited in claim 45, further comprising initiating a segment component to play the audio wave track component and play the MIDI track component such that the audio wave track component generates the playback instructions and the MIDI track component generates the event instructions.

49. A method as recited in claim 48, further comprising instantiating a segment state that initiates the segment component playing the audio wave track component and the MIDI track component.

50. A method as recited in claim 45, further comprising selecting a variation number corresponding to one or more variations of the audio wave data, and wherein generating the playback instructions includes generating the playback instructions for audio wave data associated with the variation number.

51. A method as recited in claim 45, wherein communicating the playback instructions and the event instructions includes communicating the playback instructions and the event instructions to multiple audio processing components that each generate an audio rendition that is an audible playback of the audio wave data and the MIDI audio data.

52. One or more computer-readable media comprising computer-executable instructions that, when executed, direct an audio generation system to perform the method of claim 45.

53. One or more computer-readable media comprising computer-executable instructions that, when executed, direct an audio generation system to perform the method of claim 48.

54. One or more computer-readable media comprising computer-executable instructions that, when executed, direct an audio generation system to perform a method, comprising:

playing one or more audio wave tack components;

playing one or more MIDI track components;

generating playback instructions for audio wave data with the one or more audio wave track components;

generating event instructions for MIDI audio data with the one or more MIDI track components; and communicating the playback instructions and the event instructions to an audio processing component that generates an audio rendition corresponding to the audio wave data and to the MIDI audio data; and instantiating an audio rendition manager that includes the audio processing component which generates the audio rendition as streams of audio wave data, the audio rendition manager further including audio buffers to process the audio wave data, and logical buses that each correspond to one of the audio buffers, where each of the multiple streams of audio wave data are assigned to one or more of the logical buses such that a logical bus receives one or more of the streams of audio wave data from the audio processing component and routes the streams of audio wave data to the corresponding audio buffer.

55. One or more computer-readable media as recited in claim 54, wherein the method further comprises routing the audio wave data to the audio processing component from one or more audio wave data sources.

56. One or more computer-readable media as recited in claim 54, wherein the method further comprises initiating a segment component to play the one or more audio wave track components and play the one or more MIDI track components.

57. One or more computer-readable media as recited in claim 56, wherein the method further comprises instantiating a segment state that initiates the segment component to play the one or more audio wave track components and play the one or more MIDI track components.

* * * * *